US012150544B2

(12) United States Patent
Song et al.

(10) Patent No.: US 12,150,544 B2
(45) Date of Patent: Nov. 26, 2024

(54) MODULAR BRUSH

(71) Applicants: So-Young Song, Seoul (KR); Richard Llewellyn Wilson, Seoul (KR)

(72) Inventors: So-Young Song, Seoul (KR); Richard Llewellyn Wilson, Seoul (KR)

( * ) Notice: Subject to any disclaimer, the term of this patent is extended or adjusted under 35 U.S.C. 154(b) by 606 days.

(21) Appl. No.: 17/417,107

(22) PCT Filed: Dec. 23, 2019

(86) PCT No.: PCT/KR2019/018339
§ 371 (c)(1),
(2) Date: Mar. 15, 2022

(87) PCT Pub. No.: WO2020/130758
PCT Pub. Date: Jun. 25, 2020

(65) Prior Publication Data

US 2022/0192353 A1 Jun. 23, 2022

(30) Foreign Application Priority Data

Dec. 21, 2018 (KR) ..... 10-2018-0167987
Dec. 23, 2019 (KR) ..... 10-2019-0173073

(51) Int. Cl.
*A46B 5/00* (2006.01)
*A46B 7/04* (2006.01)
*A46B 15/00* (2006.01)

(52) U.S. Cl.
CPC ..... *A46B 5/0008* (2013.01); *A46B 5/0095* (2013.01); *A46B 7/04* (2013.01); *A46B 7/048* (2013.01); *A46B 15/0093* (2013.01); *A46B 15/0095* (2013.01); *A46B 2200/1046* (2013.01); *A46B 2200/40* (2013.01)

(58) Field of Classification Search
CPC ..... A46B 5/0008; A46B 5/0095; A46B 7/04; A46B 7/048; A46B 15/0093; A46B 15/0095; A46B 2200/1046; A46B 2200/205
See application file for complete search history.

(56) References Cited

U.S. PATENT DOCUMENTS 4,890,732 A * 1/1990 Shackelford ..... A46B 7/04 206/362.1

FOREIGN PATENT DOCUMENTS

JP 2000350612 A * 12/2000
KR 2019990012375 U * 4/1999
(Continued)

OTHER PUBLICATIONS

KR 2017000969 U; Mar. 14, 2017; Jeon, S. (2 pages text; 1 page drawing).*

*Primary Examiner* — Randall E Chin
(74) *Attorney, Agent, or Firm* — Michael D. Eisenberg

(57) ABSTRACT

The present invention relates to a modular brush, with improved structure so that modular brush heads of various grades stored inside the storage compartment in the handle, are automatically exposed outwardly from the storage compartment, in connection with the cover opening movement. Thus, anybody can easily interchange one modular brush head with another. In particular, the modular brush is comprised mainly of a handle (10), cover (20), brush head portions (30), mounting portions (40), and lifting portions (50), so that by simple operation, the brush bristles in a gathered state retract into the ferrule tube of the brushhead for protection when not in use.

9 Claims, 18 Drawing Sheets

(56) References Cited

FOREIGN PATENT DOCUMENTS

| | | | | | |
|---|---|---|---|---|---|
| KR | 200387286 | Y1 | * | 6/2005 | |
| KR | 2011002812 | U | * | 3/2011 | |
| KR | 20120103809 | A | * | 9/2012 | |
| KR | 2017000969 | U | * | 3/2017 | ..... A46B 15/0069 |
| WO | WO-2014069816 | A1 | * | 5/2014 | ..... A46B 5/0016 |

* cited by examiner

MODULAR BRUSH

TECHNICAL FIELD

The present invention relates to a modular brush. More specifically, various grades of brush heads are stored in the handle compartment and through improved structure, the brush heads are automatically exposed outside of the compartment in connection with the cover opening operation, enabling anybody to easily interchange the brush heads. Particularly, the present invention relates to a modular brush that reduces the volume of the bristles by half and protects the bristles while not in use because the bristles are gathered and retract inside the ferrule by simple operation.

BACKGROUND TECHNOLOGY

Typically, brushes for makeup or art are used by carrying around a variety of brushes in a set, so that the bristles of each brush are integrated with the body according to its function. Because the brushes are selected and used one by one, when used, there has been an inconvenience in carrying around many kinds of brushes.

For example, in the case of a makeup brush, this is comprised of a brush for applying makeup. The brush is comprised of fixed bristles, a mounting ferrule, and a body. The handle torso is wand- or stick-shaped and extends to a suitable length so that it can be held by hand. Fixed on the end thereof is the ferrule which binds the bristles. And because the makeup-brush bristles are integrated into the ferrule and the ferrule is integrated to form one body with the handle torso, according to the various types of brushes and the makeup they are able to able to apply, such as lipsticks, compressed powder eye shadows, liquid mascara, blusher, etc., this results in a large volume of brushes comprised of ferrules and handle torses fixed as whole bodies. Therefore, not only can the purchase costs easily increase, but when carried during travel or to and around a film set, etc., because each makeup brush must be carried, there is the problem of extreme inconvenience due to the large volume and weight.

Thus, in the previously-disclosed utility model registration number No. 20-0404018, technology has been registered regarding: both sides of a fixed-brush body (front, back) have a conversion plate member comprising a convertible rotating plate member. As the rack gear of the conversion rotating plate member is moved by the rotation of the pinion installed on the rotating rod of the brush, the conversion rotating plate members are rotated in mutually opposite directions on the center of the axle nut. By rotation of the conversion rotating plate, the makeup brushes on both ends of the fixed-brush body are unfolded.

However, the above-mentioned conventional technology allows you to apply face touch-up makeup by unfolding the makeup brush kit according to the order of makeup when applying face touch-up makeup on the face. Nevertheless, this is inconvenient due to the complex arrangement and heavy weight, and portability is reduced, especially when the volume is increased by various kinds of brushes. Furthermore, the fact that nobody can inter-change the brushes easily has also been a nuisance.

PRIOR ART DOCUMENTS

Patent Documents (Patent Document 0001) KR 20-0404018 Y1 (2015.12.09.)

Problem the Invention is Designed to Solve.

Accordingly, the present invention being aimed at resolving the abovementioned problems, the structure is improved so that brushheads of various grades stored inside the handle compartment, are exposed outwardly from the compartment in connection with the cover opening operation, enabling anyone to easily interchange the brushheads. When using the modular brush, a brushhead stored inside the handle compartment is removed and easily attached to the end of the handle by a multi-connector and the coupling on the handle. Through operation of the moving magnetic body and fixed magnetic body in a brush head, the bristles retract into and are protected inside of the brush head, which can reduce its volume when unused and protect the stored bristles from damage. Again, through operation of the moving magnetic body and of the fixed magnetic body of the brush head, the modular brush is formed with the purpose that the bristles protrude outside of the brush head so it can be used.

Means of Resolving Problem

According to a preferred embodiment of the present invention, it is characterized by a handle (10), in which a compartment (12) is formed, the handle being provided with coupling (14) at its end; comprising any one of a cover (20) being configured to open and close the compartment (12) when linearly moved in a longitudinal direction of the handle (10); or a cover tube (20*a*) having cither a polygonal or cylindrical section to encase the handle (10); or C-shaped cover (20*b*) having shape corresponding to shape of the compartment (12); comprising a brush head portion (30), wherein a plurality of brush head portions arc accommodated in the compartment (12), and wherein the brush head portion is provided with multi-connector (32) configured to connect and lock the coupling (14) of the handle (10) so that any one of brush head portions can be selectively drawn out and connected with the coupling (14); comprising a mounting portion (40) being arranged on a plurality of positions in the compartment (12) so that it can rotate about a pivotal axis (42) or pivotal protrusion (42*a*) and being provided with a mounting protrusion (44) so that it is connected with the multi-connector (32) of the brush head portion (30); and comprising a lifting portion (50) configured to make the brush head portion (30) protrude outside the compartment (12) by way of pivotal movement of the mounting portion (40) at an angle of inclination in connection with opening of the cover (20).

According to another embodiment of the present invention, it is characterized in that the coupling (14) and the multi-connector (32) are attached to each other by way of magnetic body or connected with each other in a fitting manner by users wherein the coupling (14) and the multi-connector (32) are respectively configured to have a fitting groove and fitting hole.

According to another embodiment of the present invention, it is characterized in that the lifting portion (50) is comprised of the pinion gear (45) or wheel (45*a*) installed concentrically on the pivotal shaft (42) or the pivotal protrusions (42*a*) of the mounting portion (40), and in order to mesh with the pinion gear (45) or wheel (45*a*) the cover (20) is comprised with a rack gear (25) or teeth (25*a*). The rack gear (25) or teeth (25*a*) is or are installed at the end of the cover (20), and when the end of the cover (20) moves adjacent to the mounting portion (40) during the cover (20) opening operation, the rack gear (25) aligns with and pivots the pinion gear (45), or the teeth (25*a*) align with pivot the wheel (45*a*). Thereupon, the mounting portion (40) pivots causing a brush head portion (30) to pivot to an incline angle which exposes the brush head portion (30) outside the compartment (12). Or alternatively, a worm gear is rotated by means of a third gear, wheel, cog, grip, worm gear, or pulley belt provided on the cover (20), which pivots the mounting portion (40) thereby causing the brush head portion (30) to be exposed outside of the compartment (12).

According to another embodiment of the present invention, it is characterized in that the brush head portion (30) comprises a ferrule (31) arranged at the end of the handle (10), a separating plate (33*b*), which is arranged in the ferrule (31) and provided with a female thread (33*a*), a push piece (33*f*) provided with male screw (33*d*), which makes screw joint with the female thread (33*a*), wherein the push piece is provided with a multi-connector (32) at one end and moving magnetic body (33*c*) at the other end, and a tilting plate (33*i*) arranged in the ferrule (31) wherein the tilting plate (33*i*) is provided with fixed magnetic bodies (33*g*) on one side and bristles (33*h*) on the other side, that the moving magnetic body (33*c*) is arranged on a plurality of positions with respect to the fixed magnetic bodies (33*g*) wherein its surface forms inclined surface or horizontal surface when it corresponds with the fixed magnetic bodies (33*g*) wherein the tilting plate (33*i*) is accommodated into the ferrule (31) with its diameter reduced and in bent state when the moving magnetic body (33*c*) moves in among the fixed magnetic bodies (33*g*) by way of screw movement of the push piece (33*f*) and the inclined surface or horizontal surface of the fixed magnetic bodies (33*g*) attaches to the moving magnetic body (33*e*), or that the brush head portion (30) comprises a ferrule (31) arranged at the end of the handle (10), a separating plate (33*b*), which is arranged in the ferrule (31) and provided with a female thread (33*a*), a push piece (34*f*) provided with male screw (33*d*) which makes screw connection with the female thread (33*a*), wherein the push piece is provided with a multi-connector (32) at one end and moving magnetic body (34*e*) at the other end, and a tilting plate (34*i*) arranged in the ferrule (31) wherein the tilting plate (34*i*) is provided with fixed magnetic bodies (34*g*) on one side and bristles (34*h*) on the other side, wherein the moving magnetic body (34*e*) moves with screw pitch and attaches to the fixed magnetic bodies (34*g*) by way of screw movement of the push piece (34*f*) wherein the bristles (34*h*), while being gathered together are accommodated into the ferrule (31) when the tilting plate (34*i*) is drawn by way of reverse screw pitch movement of the push piece (34*f*).

According to another embodiment of the present invention, it is characterized in that the brush head portion (30) comprises a ferrule (31) arranged at the end of the handle (10), a base plate (35*b*) arranged in the ferrule (31) and provided with a multi-connector (32) on one side and radially-arranged composite magnetic bodies (35*a*) on the other side, and a spiral coil member (35*f*) having conical shape, into which a spiral cable (35*e*) is built, wherein the spiral coil member (35*f*) is provided with magnetic-body layers (35*c*), which is configured to attach to the composite magnetic bodies (35*a*) on one side, and with bristles (35*d*) on the other side, that the bristles (35*d*), while gathering together are accommodated into the ferrule (31) when the magnetic-body layer (35*c*) of the spiral coil member (35*f*) attaches to composite magnetic bodies (35*a*) of the base plate (35*b*) and is compressed in a plate shape, that magnetic sections and opposite magnetic sections of the composite magnetic bodies (35*a*) are alternately arranged in a radial manner wherein the magnetic-body layers (35*c*) of the spiral coil member (35*f*) corresponds to the magnetic sections and are arranged at equidistant intervals, wherein the bristles (35*d*), while gathered together are accommodated into the ferrule (31) when the magnetic-body layers (35*c*) of the spiral coil member (35*f*) attach to the magnetic sections of the composite magnetic bodies (35*a*) of the base plate (35*b*) and arc compressed in a plate shape, wherein the magnetic-body layers (35*c*) of the spiral coil member (35*f*) corresponds to the opposite magnetic sections of the composite magnetic bodies (35*a*) by way of pivotal movement of the base plate (35*b*) so that repellent force makes the spiral coil member (35*f*) expand in a conical manner and makes the bristles (35*d*) protrude outside, or that the spiral cable (35*c*) is further configured in the spiral coil member (35*f*) so that the spiral coil member (35*f*) can be provided with elastic force.

According to another embodiment of the present invention, it is characterized in that the brush head portion (30) comprises a ferrule (31) arranged at the end of the handle (10), a base plate (36*b*) arranged in the ferrule (31) and provided with a multi-connector (32) on one side and radially-arranged composite magnetic bodies (36*a*) on the other side, and a sector-shaped plates (36*c*) arranged in a radial manner to attach to the composite magnetic bodies (36*a*) and configured to have magnetic-body layer (36*c*) or form magnetic-particle cluster (36*c*') on one side and bristles (36*d*) on the other side, wherein the sector-shaped plates (36*e*) is provided with any one of slots (36*g*') tilted at an angle on one side so that slots (36*g*) or the sector-shaped plates (36*c*) come together and protrusions (36*h*) having shape corresponding to shape of the slots (36*g*) wherein protrusions (36*h*) of the sector-shaped plates (36*e*) are connected with slots (36*g*) of the sector-shaped plates (36*e*) so that the plurality of the sector-shaped plates (36*e*) can be connected with each other to extend and slide.

According to another embodiment of the present invention, it is characterized in that the brush head portion (30) comprises a ferrule (31) arranged on the handle (10) and having a linear guide hole (31*a*) at its end and a sector-shaped guide hole (31*b*) configured to encompass the guide hole (31*a*), a push piece (37*b*) configured to have a multi-connector (37*a*) at the end of the ferrule (31), an elastic member (37*d*) arranged at the end of linear guide hole (31*a*) and extend in a sector-like manner and provided with bristles (37*c*), and moving magnetic bodies (37*e*) formed on perimeter of the elastic member (37*d*), and fixed magnetic bodies (37*f*) provided on a sector shape guide hole (31*b*) of the ferrule (31), wherein the push piece (37*b*) is transferred outwardly of the ferrule (31) and the elastic member (37*d*) approaches to section of the sector shaped guide hole (31*b*) so that the moving magnetic bodies (37*e*) attach to the fixed magnetic bodies (37*f*) and the elastic member (37*d*) extends thus the bristles (37*c*) expand in a sector-like manner, wherein the clastic member (37*d*) is a flexible tube so that the bristles (37*c*) can extend in a sector-like manner or guide stems (37*g*) are further provided on both sides of the elastic member (37*d*) so that the bristles (37*c*) can extend in a sector-like manner.

According to another embodiment of the present invention, its is characterized in that the brush head portion (30) comprises a ferrule (31) arranged at the end of the handle (10), a push piece (38*d*) arranged in the ferrule (31) and provided with a multi-connector (38*a*) on one side and a fixed magnetic bodies (38*b*) on the other side, wherein the push piece is provided with magnetic-particle cluster (36*c*') on its surface or inside and incline rails (38*c*) arc radially arranged on their perimeter with their distance reduced toward the fixed magnetic bodies (38*b*), a plurality of guide rails (38*c*), which move in a proximity with the incline rails (38*c*) of the push piece (38*d*) and extend by way of tilting movement, or alternatively guide rails (38*c*), on which multiple-inclined rails (38*c*') having different angle of inclination on their ends so that extending distance thereof increases according to distance of tilting movement with respect to the incline rails (38*c*), a tilting plate (38*h*) arranged at the end of the guide rails (38*e*) and provided with bristles (38*f*) on one side and moving magnetic bodies (38*g*) configured to attach to fixed magnetic bodies (38*b*), bar-shaped metal support (38*i*) arranged in the guide rails (38*c*), and moving magnetic bodies (38*g*) connected with the bar-shaped metal support (38*i*) and radially arranged in the tilting plate (38*h*) or magnetic surface (38*j*) formed inside the incline rails (38*c*) without bar-shaped metal support (38*i*), wherein the guide rails (38*e*) conduct tilting movement by way of force of movement of protruding push piece (38*d*) so that the guide rails (38*e*) push the incline rails (38*c*) without contact, wherein the tilting plate (38*h*) attaches to the push piece (38*d*) by way of force of attachment of the fixed magnetic bodies (38*b*) and moving magnetic bodies (38*g*) with distance of push pieces (38*d*) increased, wherein the tilting plate (38*h*) flexes by way of extending movement of the push pieces (38*d*) so that the bristles (38*f*) can gather together with its diameter reduced and be accommodated in the ferrule (31).

According to another embodiment of the present invention, it is characterized by any one of construction comprising a ferrule (60) arranged at the end of a handle (10), a bristle-attaching portion (70), which is partially accommodated in the ferrule (60) and has bristles (71) on one side and any one of shaft (72) downwardly extending on central lower surface of the bristle-attaching portion (70) or a plurality of bars (73) attaching to lower surface of the bristle-attaching portion (70), wherein the shaft (72) or the bars (73) are drawn downwardly of the ferrule (60) so that the bristle-attaching portion (70) can flex in a curved manner with respect to its center and the bristle-attaching portion (70) can be accommodated in the ferrule (60) with diameter of the bristle-attaching portion (70) reduced, wherein the bristle-attaching portion (70) can flex in a curved manner with respect to its center portion and the bristle-attaching portion (70) can encase the shaft (72) outside the shaft (72) to further reduce diameter of the bristle-attaching portion (70), wherein tube (74) having larger diameter than that of the shaft (72) is further provided and its end is fixed to a lever fixing portion (61) arranged in inner wall of the ferrule (60), wherein a lever (62) is inserted into guide hole (72*a*) (74*a*) formed in the shaft (72) and the tube (74) and configured to penetrate guide hole (60*a*) formed in the ferrule (60) so that the lever (63) can move downward along the guide hole (60*a*) of the ferrule (60) and position of the shaft (72) is temporarily maintained wherein the bar (73) and tube (74) primarily moves downward and the lever (62) pushes the shaft (72) with reduced diameter of the bristle-attaching portion (70) so that the bristle-attaching portion (70) is inserted into inner wall of the ferrule (60) without contact; or construction comprising track (63) having groove shape configured along perimeter of the ferrule (60), an adjuster-ring (64) provided with pin (64*a*), which is configured to protrude inwardly wherein the pin (64*a*) is configured to insert into curved guide holes (72*b*) (74*b*) arranged on outer surface of the shaft (72) and tube (74) and the adjuster-ring (64) is adjusted with the pin (64*a*) inserted into the guide holes (72*b*) (74*b*) so that velocity of downward movement of the shaft (72) and tube (74) is respectively adjusted according to curved shape of the guide holes (72*b*) (74*b*) wherein the bristle-attaching portion (70) is inserted into the ferrule (60) with reduce diameter; or construction comprising the shaft (72) provided with a plurality of bars (73), which are configured to extend outwardly of the shaft (72), wherein the tube (74) provided with guide hole (74*c*), into which the bar (73) penetrates, so that the shaft (72) can upwardly or downwardly slide with constant distance, wherein the bristle attaching portion (70) is inserted into the ferrule (60) with retraction according to adjustment of polarity of moving magnetic bodies (39*e*) configured on one side of the shaft (72) and fixed magnetic bodies (39*b*) provided on coupling (14) of the handle (10); or construction comprising a spring (76) arranged between distance plate (65) provided at the center of the ferrule (60) and a stopper (75) configured by outwardly protruding end of the shaft (72) wherein the bristle attaching portion (70) is connected with the coupling (14) with retraction so that the bristle-attaching portion (70) can be inserted into the ferrule (60) with retraction due to the spring (76).

According to another embodiment of the present invention, it is characterized by an Elastic Body (46*a*) provided on the lifting portion (50) in order for the pivotal shaft (42) of the mounting portion (40) to rotate in one direction; an incline guide (46) formed on one end of the mounting portion (40) corresponding with the cover (20); the straight guide (26) is formed on one side of the cover (20) corresponding with the straight guide n (26). During the closing operation of the cover (20), while the incline guide (46) is pressed by the straight guide (26) and the mounting portion (40) compresses the Elastic Body (46*a*), the mounting portion (40) pivots, and the brush head portion (30) is accommodated inside the compartment (12). It is configured so that, during the opening operation of the cover (20), while releasing the pressure that was applied by the straight guide (26) on the incline guide (46), the mounting portion (40) pivots in the reverse direction due to the expansion of the Elastic Body (46*a*), and the brush head portion (30) is exposed outside the compartment (12).

Effect of the Invention

According to the above configuration and operation, the present invention has improved structure so that modular brush heads of various grades stored inside the storage compartment in the handle, are automatically exposed outwardly from the storage compartment, in connection with the cover opening movement. Thus, anybody can easily interchange one modular brush head with another. In particular, by simple operation, the brush bristles, in a gathered state, retract into the ferrule tube of the brushhead for protection when not in use.

SPECIFIC DETAILS FOR IMPLEMENTING THE INVENTION

Figure 1:
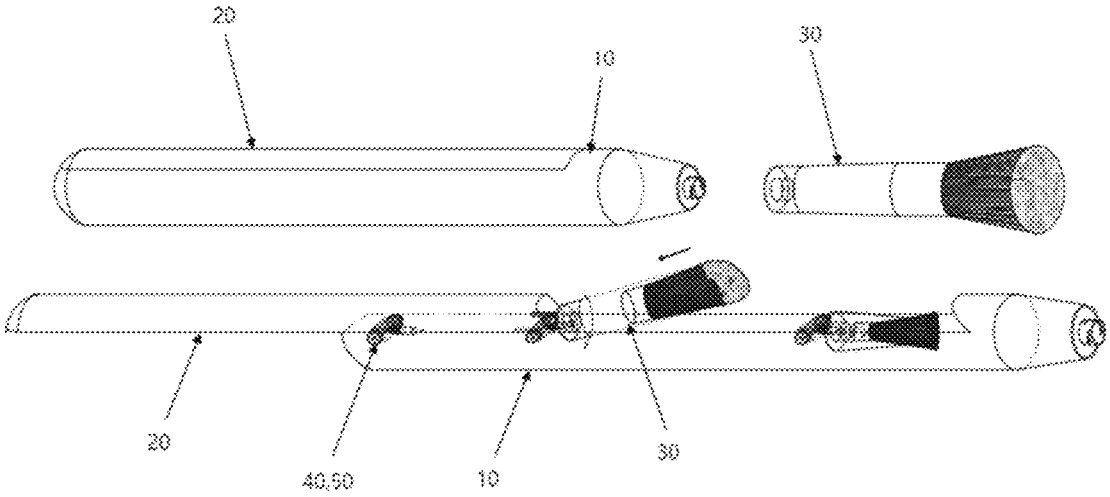
FIG. 1 to FIG. 2 are configuration diagrams showing a modular brush in accordance with an embodiment of the present invention as a whole.

Hereinafter, preferred embodiments of the present invention will be described in detail with reference to the accompanying drawings.

The present invention relates to a modular brush, which has an improved structure so that brush heads of various grades stored in the handle (10) are automatically exposed outside of the compartment in connection with the Cover opening operation, and the brush heads can be easily interchanged by anyone. Especially by simple operation, the bristles in a gathered state, retract inside the brush head portion (30). Accordingly, it is comprised primarily to include a Handel (10), cover (20), brush head portions (30), mounting portions (40), and lifting portion (50).

The handle (10) according to the present invention comprises a compartment (12); is provided with a coupling (14) on the end; and the handle (10) is provided with a cover (20) to open and close the compartment (12) while moving in a straight line in a longitudinal direction.

Figure 10:
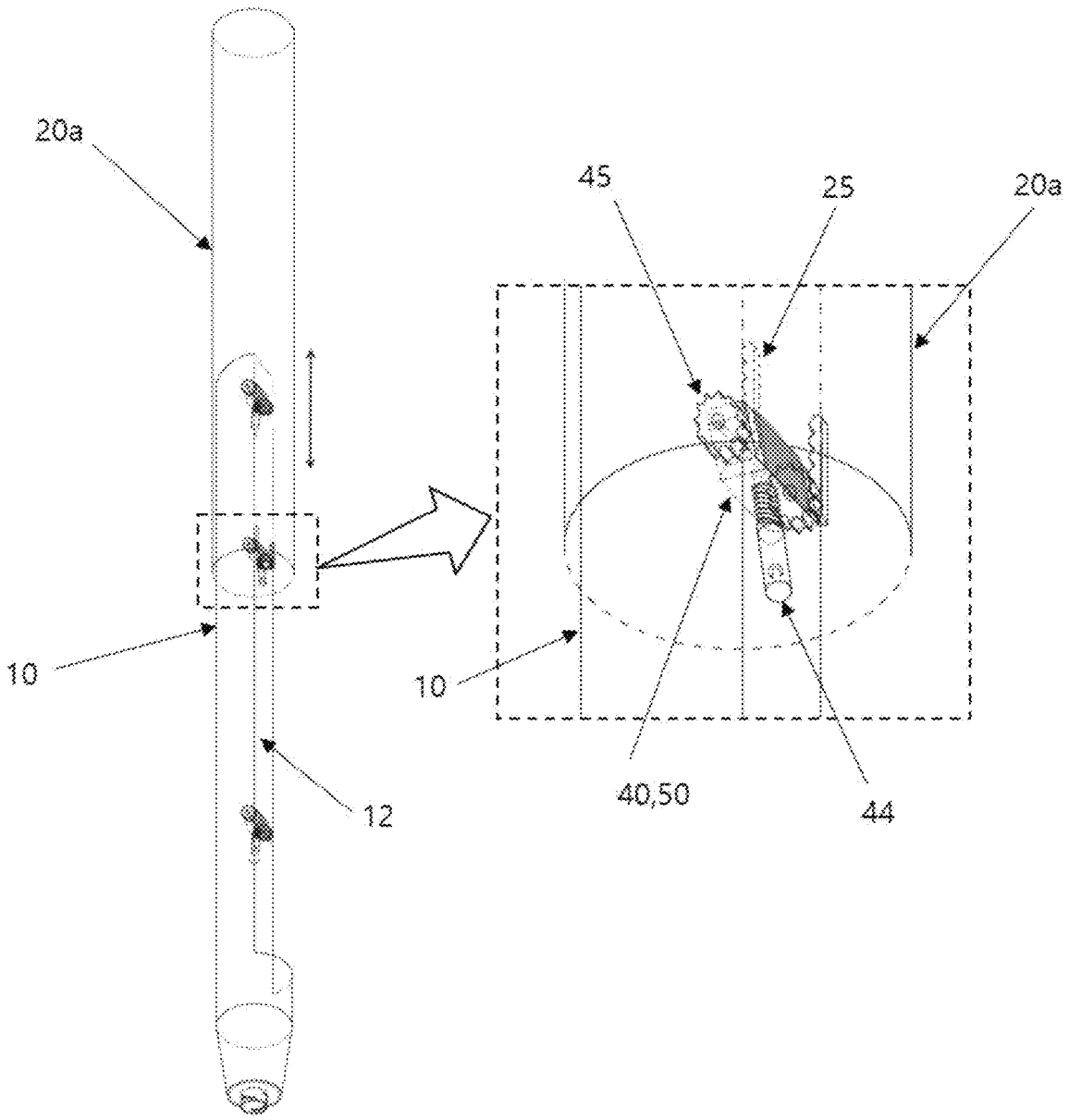
FIG. 10 to FIG. 11 are configuration diagrams showing a cover tube and a C-type Cover tube of a modular brush according to embodiments of the present invention.
Figure 11:
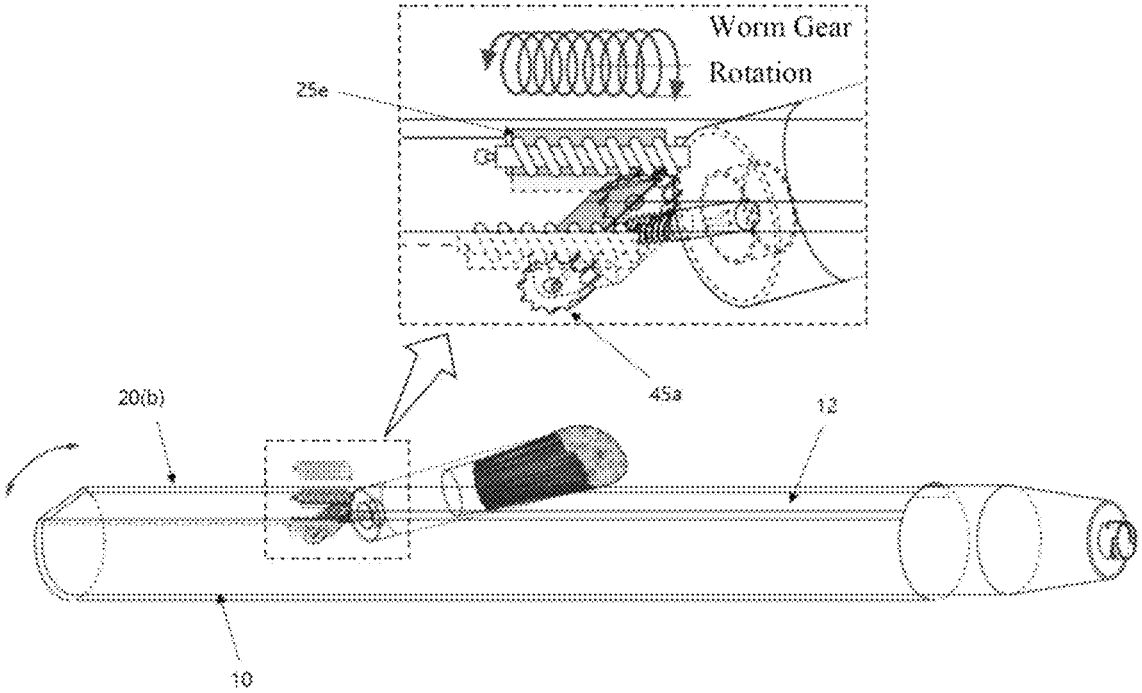

Here, according to another embodiment, as shown in FIGS. 10 to 11, instead of the cover (20), there can be a cover tube (20*a*) formed to encase the handle (10). This can be replaced by a C-shaped cover (20*b*) that is shaped to correspond to shape of the compartment (12) and may be combined with the handle (10). The cover tube (20*a*) or C-shaped cover (20*b*) can be configured to slide in the longitudinal direction of the handel (10) or to rotate, in order to open and close the compartment (12).

In addition, when the compartment (12) is opened and closed by the cover tube (20*a*) or C-shaped cover the mounting portion (40) may be configured so as to move pivotally by way of a worm gear.

Figure 2:
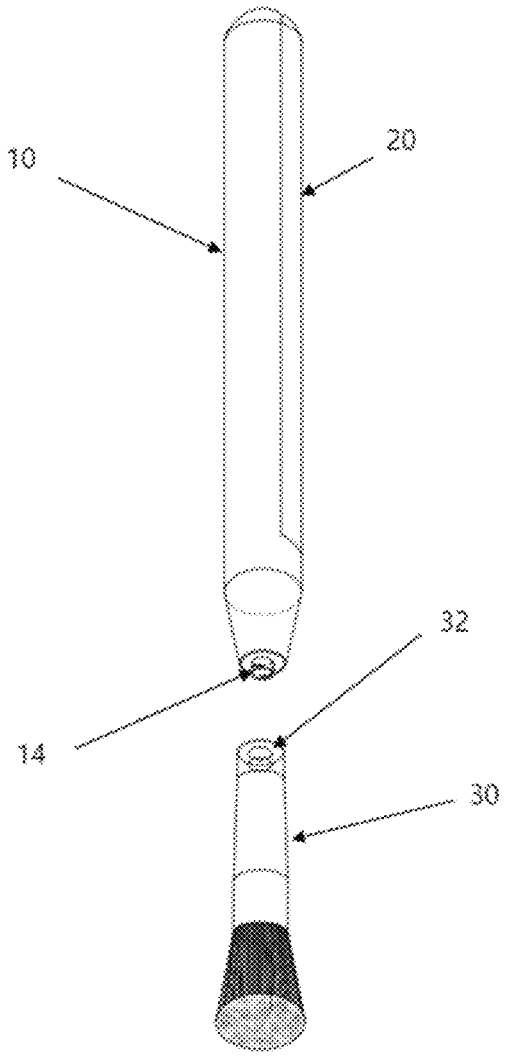

And, as shown in FIGS. 1 to 2, a plurality of brush head portions (30) may be housed in the compartment (12). Any one of the brush head portions (30) is selectively drawn out, and (10) Multi-coupling (32) is provided in the brush head portion (30) in order for it to be attached to the coupling (14) of the Handle. Various embodiments of the brush head portion (30) are described in detail through FIGS. 3 to 19 to be described later.

Although a preferred embodiment is to provide for the coupling (14) and the Multi-coupling (32) be attached by magnets, the present invention is not limited thereto, and the user may fit the coupling (14) and the Multi-coupling (32) by means of a groove and a fitting hole formed therein, respectively.

In addition, mounting portions (40) according to the present invention are provided in a plurality of places inside the compartment (12), and are pivoted around the pivotal shaft (42) or pivotal protrusions (42*a*). A mounting portioning protrusion (44) is provided so as to connect with the Multi-coupling (32) of the brush head portion (30). That is, the Multi-coupling (32) of the brush head portion (30) is housed inside the compartment (12) in a state fitted on the mounting portioning protrusion (44) of the mounting portion (40). By the turning movement of the mounting portion (40), the brush head portion (30) is exposed to the outside of the compartment (12) and is then easily taken out. At this time, the pivoting movement of the mounting portion (40) occurs automatically due to the subsequent movement of the lifting portion (50).

At this time, the lifting portion (50) provides for exposing brush head portions (30) outside of the compartment (12) by pivoting the mounting portion (40) at an inclined angle in connection with the cover (20) opening operation.

Figure 3:
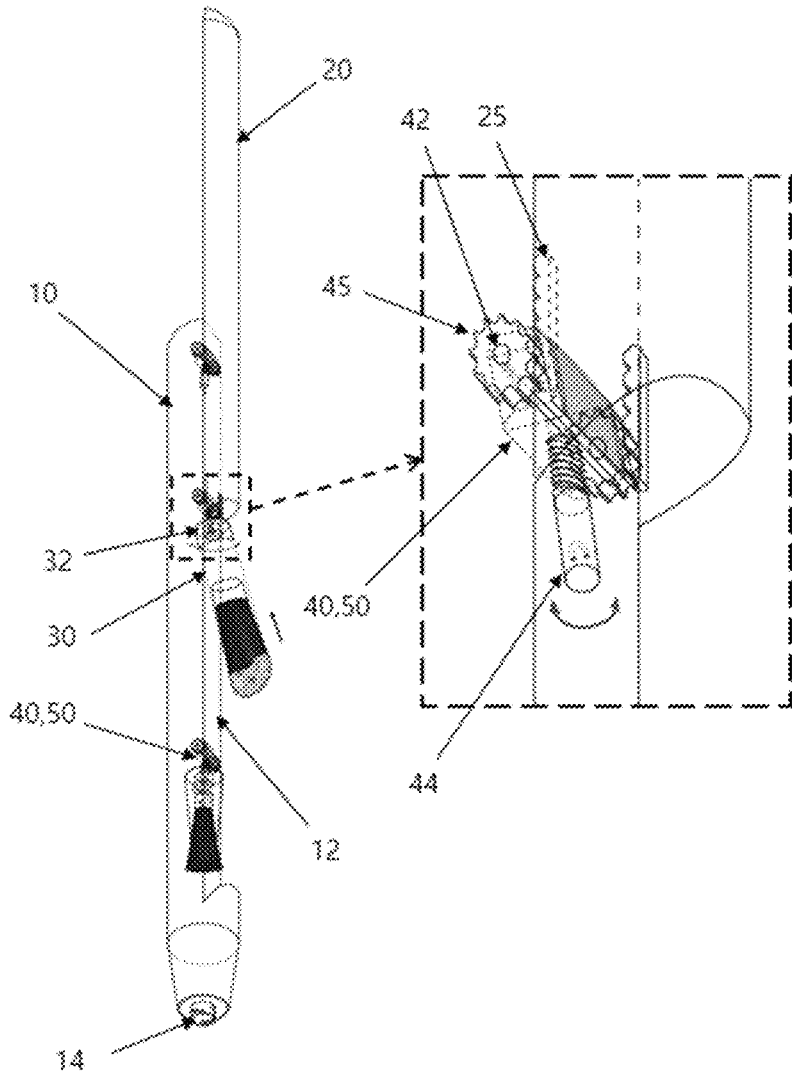
FIGS. 3 to 9 arc configuration diagrams showing the lifting portion of a modular brush according to embodiments of the present invention.

In FIG. 3, the lifting portion (50) consists of: a pinion gear (45) installed concentrically on the mounting portion (40)'s pivotal shaft (42) or on the mounting portion (40)'s pivotal protrusions (42*a*) in FIG. 3(*d*); and a rack gear (25) installed on the cover (20) to couple with the pinion gear (45). The above rack gear (25) is installed at the end of the cover (20).

Thus, during the cover (20) opening action, if the end of cover (20) moves on mounting portion (40), pinion gear (45) is coupled with and pivots the rack gear (25). By means of pivoting mounting portion (40), brush head portion (30) is pivoted at an inclined angle providing for it to be exposed outside of compartment (12). The pinion gears (45) and mounting portion (40) can be comprised as one part or can be comprised of two parts.

Figure 4:
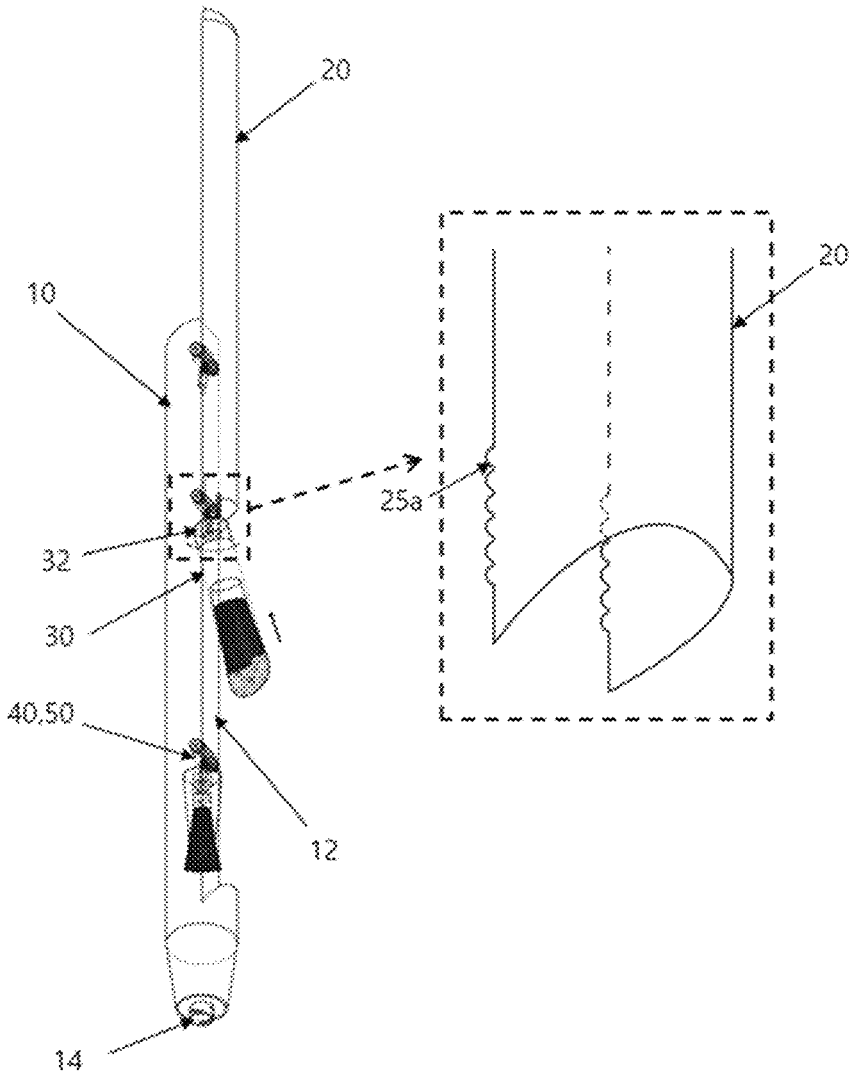

According to another embodiment of the present invention, in FIG. 4, instead of a rack gear (25), teeth (25*a*) may be formed integrally into the end of cover (20).

Figure 5:
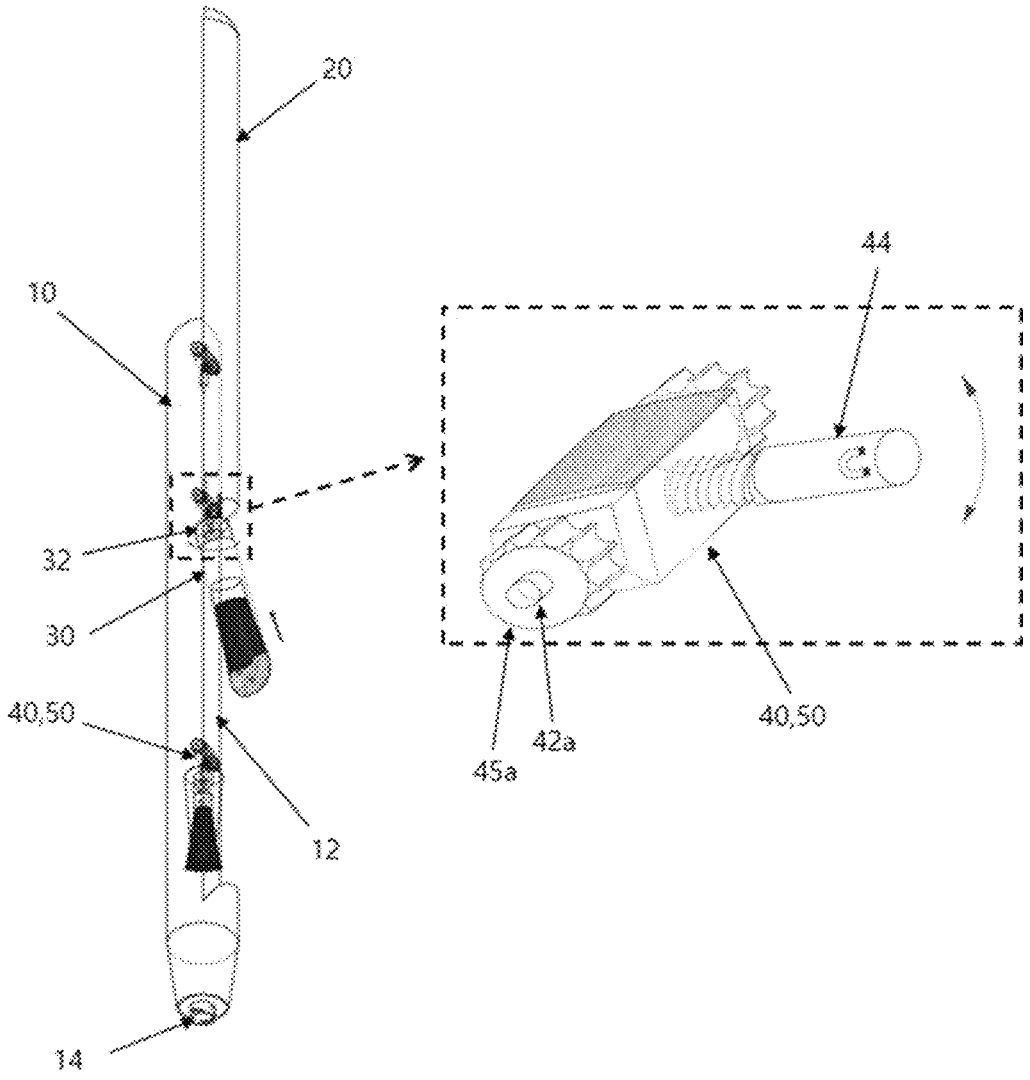
Figure 6:
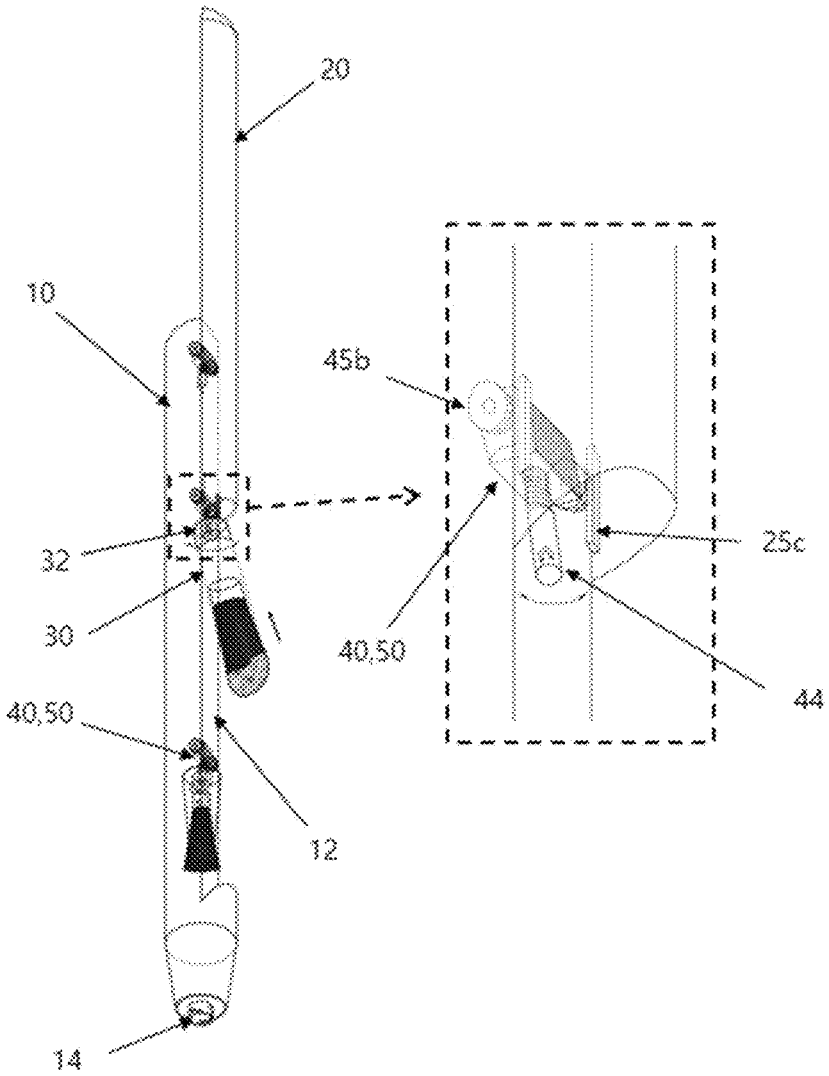

In addition, in FIG. 5, instead of the pinion gear (45), a wheel (45*a*) in the form of a partial gear may be provided. Instead of the pivotal shaft (42), pivotal protrusions (42*a*) may be provided. As shown in FIG. 6, instead of the rack gear (25), a Slidable wheel (25*b*) may be provided. Instead of the pinion gear (45), a wheel including Magnetic Body (45*b*) may be provided.

Figure 7:
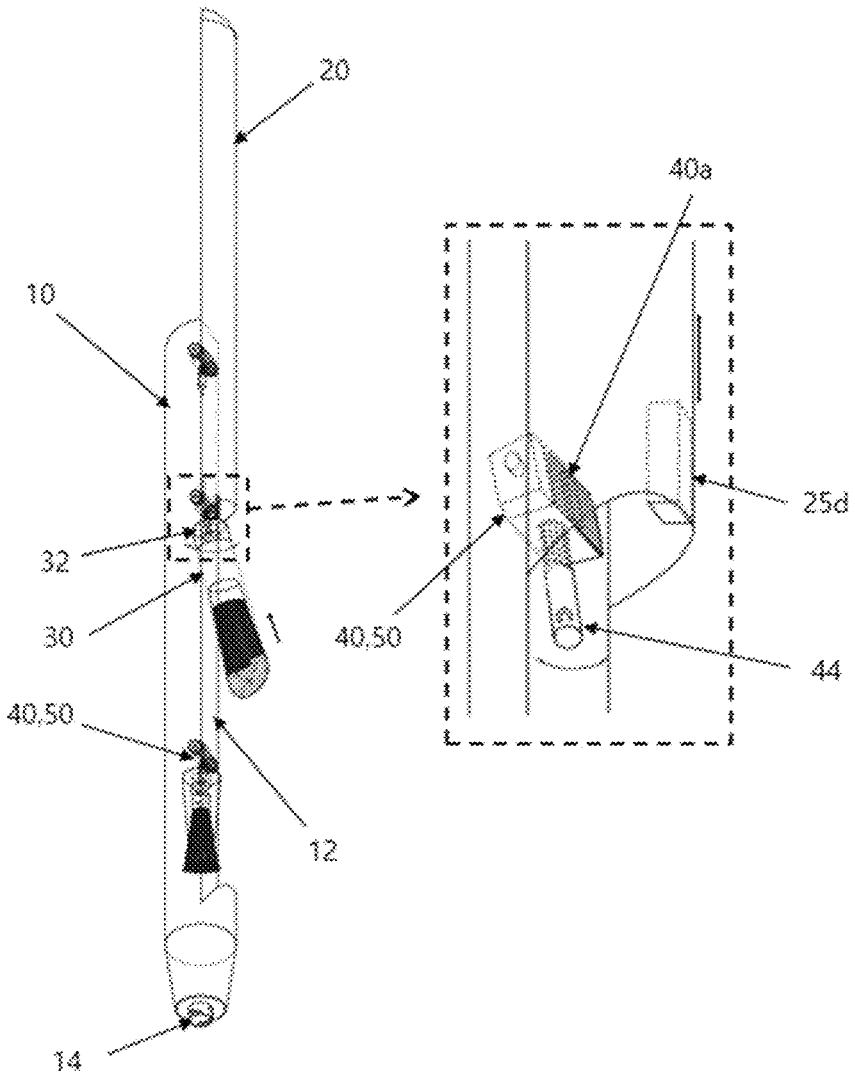

In addition, as shown in FIG. 7, instead of the rack gear (45), a Magnetic Body (40*a*) provided on one surface of the mounting portion (40), and a Magnetic Body (40*a*) may be provided on the corresponding inner surface of the cover (20). Directly on both ends of the mounting portion (40), a pivotal shaft (42) may be provided or pivotal protrusions (42*a*) may be provided.

Figure 8:
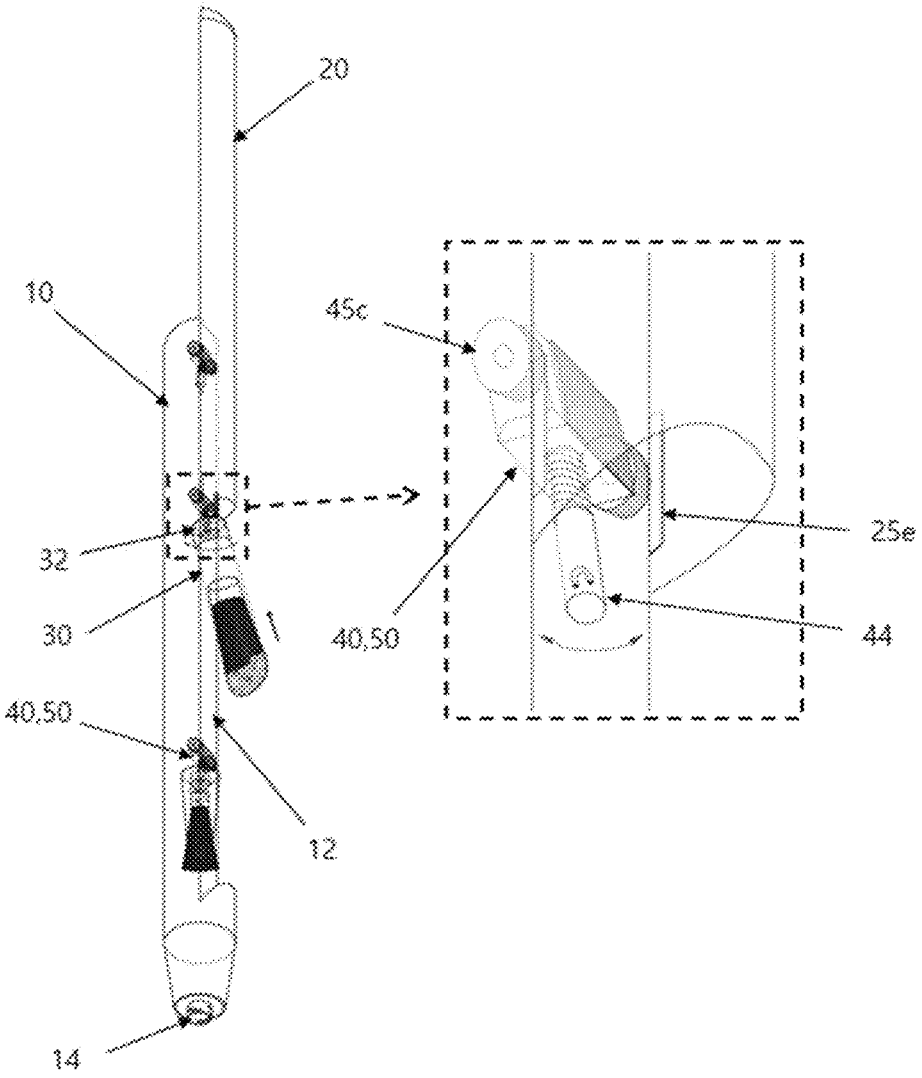

In addition, as shown in FIG. 8, instead of the rack gear (25), a Grip (25*e*) formed of a material such as rubber, latex, silicone, etc. at the end of the cover (20). It may be configured with pinion gears (45), wheel (45*a*) (45*b*), or wheels (45*c*) comprised of a material selected from among, rubber, silicone, plastic, etc.

Figure 9:
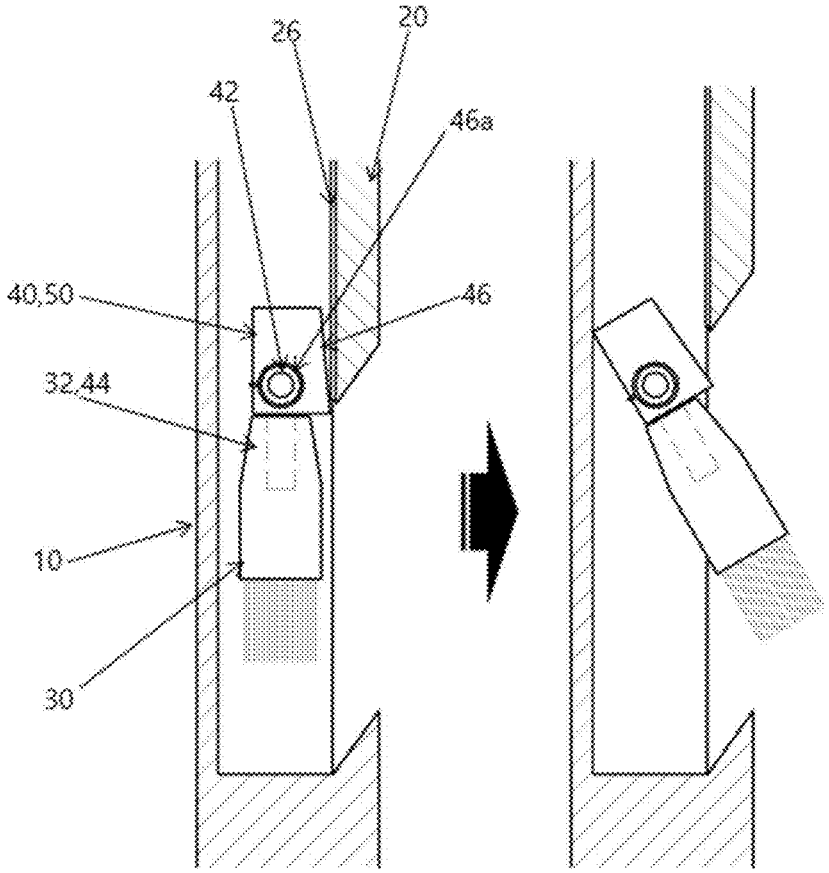

In FIG. 9, the lifting portion (50) is comprised of: an elastic member (46*a*) provided to rotate the pivotal shaft (42) of the mounting portion (40) in one direction; a Slope guide (46) formed on one side of the mounting portion (40), and corresponding to the cover (20); and a straight guide (26) formed on one surface of the cover (20) in a position corresponding to the Slope guide (46).

Thus, during the cover (20) closing operation, the incline guide (46) is pressurized by the straight guide (26), and while the mounting portion (40) compresses the Elastic Body (46*a*), the mounting portion (40) pivots, and the brush head portion (30) is accommodated inside the compartment (12). During the cover (20) opening operation, the pressure in the elastic member (46*a*) caused by the incline guide (46) on the straight guide (26), is released, and through the expansion of the elastic member (46*a*), the mounting portion (40) pivots in the reverse direction, providing for the brush head portion to be exposed outside of the compartment (12).

Figure 12:
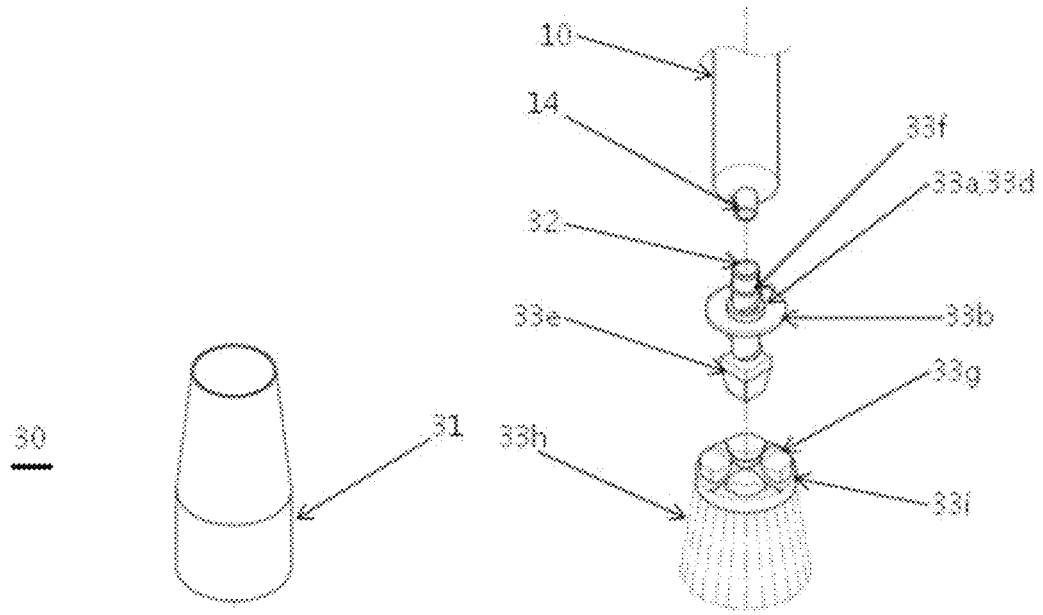
FIGS. 12 to 21 are configuration diagrams showing a variety of embodiments of the brush head portion of a modular brush according to embodiments of the present invention.
Figure 13:
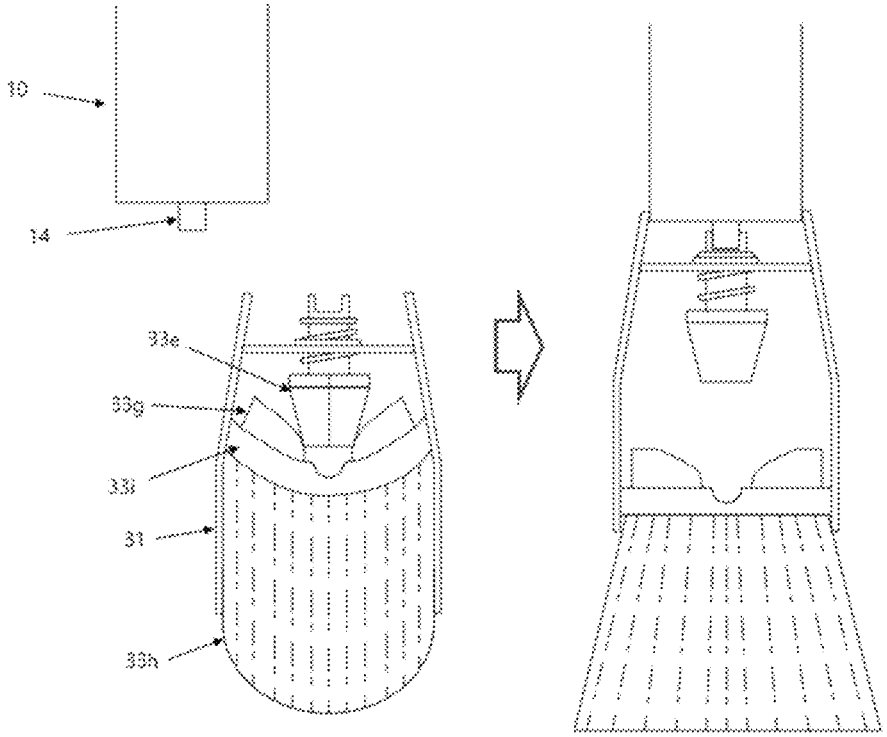

In FIGS. 12 to 13, the brush head portion (31) is comprised of a ferrule (31) installed on the end of the handle (10) and installed in the ferrule (31), and a distance plate (33*b*) which forms a female thread (33*a*), a male thread (33*d*) is formed both to screw into the female thread (33*a*) and at one end of the male thread (33*d*) is formed a multi-connector (32) and at the other end is formed a moving magnetic body (33*e*) provided with a push piece (33*f*), installed inside the ferrule (31). On a surface(s) facing the push piece (33*f*) are arranged fixed magnetic bodies (33*g*) and on the reverse surface bristles (33*h*) are arranged to form a tilting plate (33*i*). The male thread (33*d*) and the distance plate (33*b*)

may be formed as one body, or the male thread (33*d*) and distance plate (33*b*) may each be comprised of separate parts, and can be configured optionally according to the initial design.

And, the moving magnetic body (33*c*) is arranged radially in a plurality of places around the fixed magnetic body (33*g*). A surface corresponding to the fixed magnetic body (33*g*) is formed at an incline. When the moving magnetic body (33*c*) enters between the fixed Magnetic Body (33*g*) by the spiral motion of the push piece (330, the inclined surface of fixed magnetic bodies attach to the moving magnetic bodies (33*e*) and the tilting plate (33*i*) is curved. With the diameter of the tilting plate (33*i*) in a reduced state, it is configured to retract inside.

Figure 14:
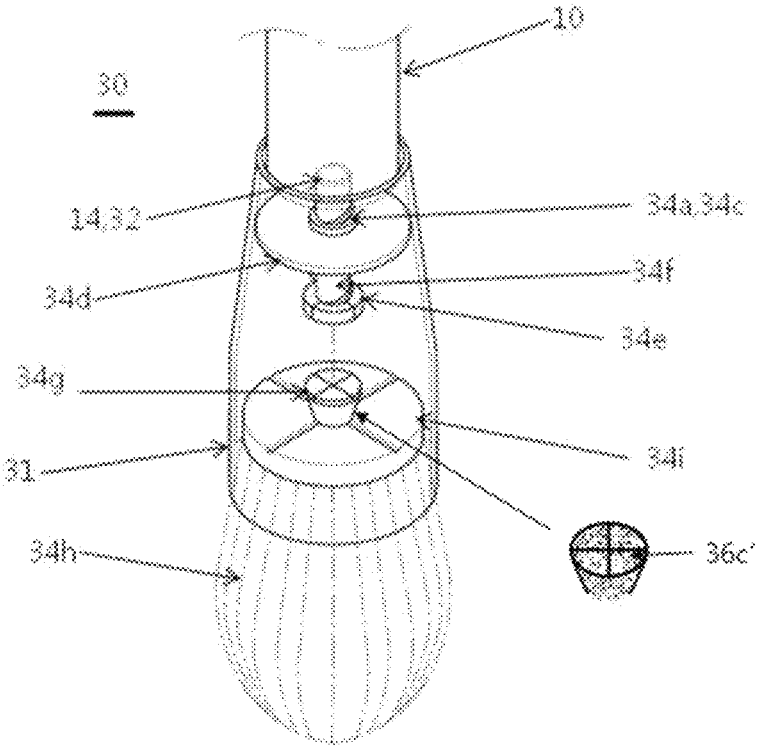
Figure 15:
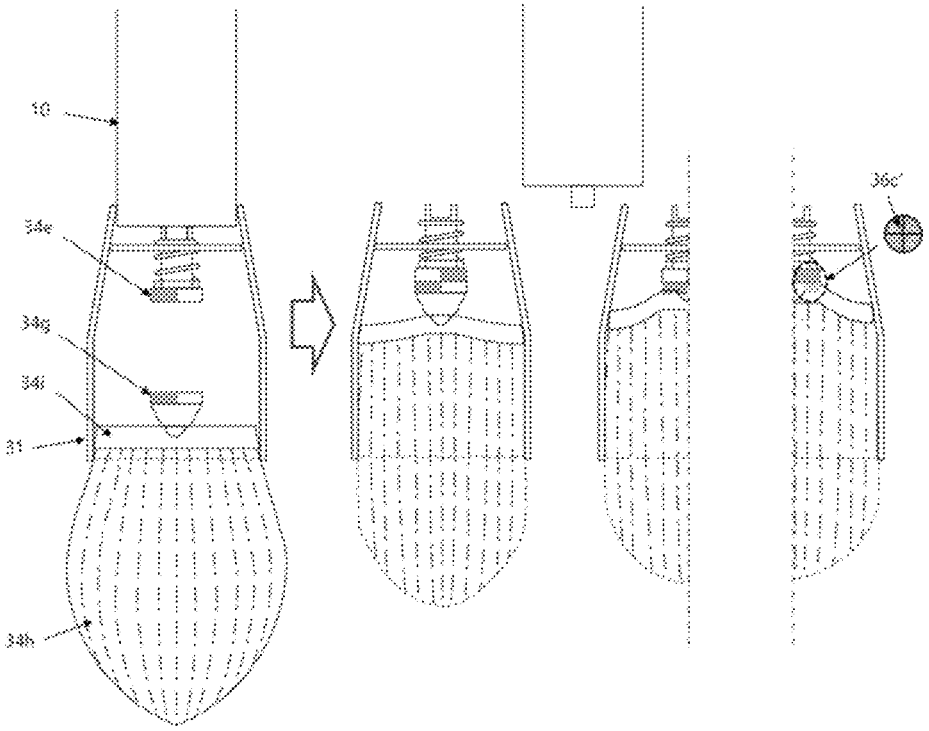

In FIGS. 14 to 15, the brush head portion (30) is comprised of: a ferrule (31) installed at the end of the handle (10); inside the ferrule (31) is installed a distance plate (34*d*), in which is formed a female thread (34*a*); a male thread (34*c*) is formed to be screwed into the female thread (34*a*). On one end of the male thread (34*c*) is formed a multi-connector (32) and on the other end is provided a push piece (34*f*) comprised of moving magnetic bodies (34*e*), installed inside the ferrule (30). On a surface corresponding to the push piece (34*f*) are provided fixed magnetic bodies (34*g*), and on the other surface is formed bristles (34*h*), comprising a Tilting Plate (34*i*).

According to this, the moving magnetic body (34*e*) is moved in a pitch motion by means of the spiral movement of the push piece (340, and attaches to the fixed magnetic bodies (34*g*), so that when the tilting plate (34*i*) is pulled by reverse pitch motion of the push piece (340, it provides for the bristles (34*h*) to be gathered and accommodated into the ferrule (31).

Here, instead of the fixed magnetic body (34*g*) on the top of the tilting plates (34*i*), it may be composed by magnetic-particle clusters (36*c*') deposited in protrusions on the Tilting Plates (34*i*).

Figure 16:
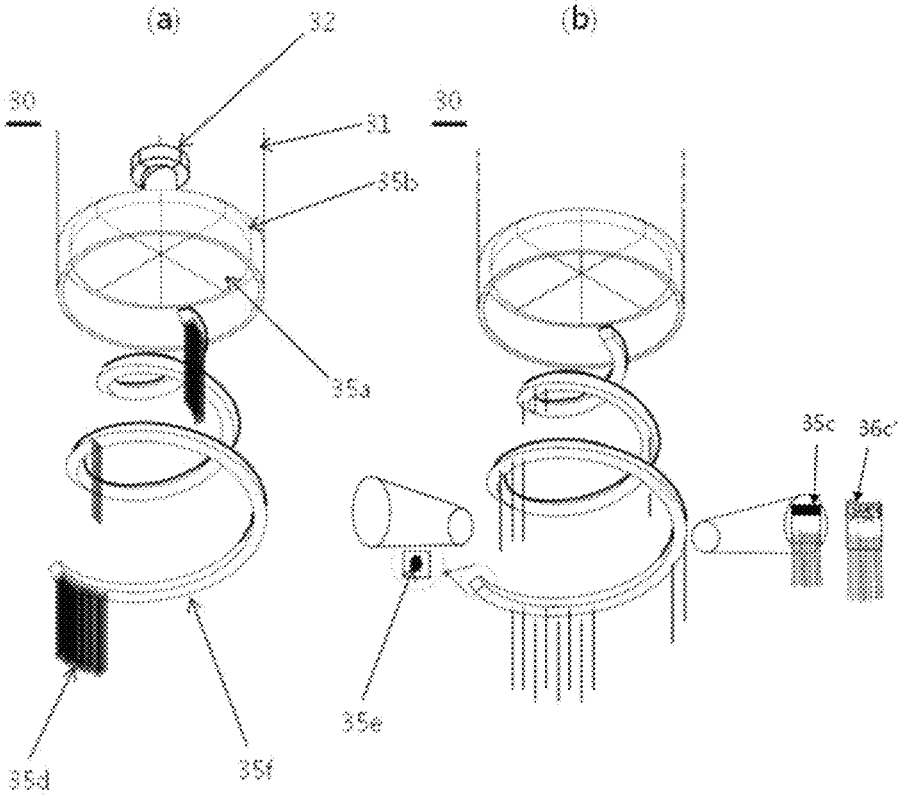

In FIG. 16, the brush head portion (30) has a multi-connector (32) formed inside one end of its ferrule (31) that is installed onto the end of the handle (10). On another surface is arranged radially, base plates (35*b*) comprising a composite magnetic body (35*a*) and to attach to the composite magnetic body (35*a*), a magnetic body layer (35*c*) is deposited on or in a surface. On another surface bristles (35*d*) are installed, and in between the surfaces is laid a spiral cable (35*e*), forming a conical-shaped Spiral Coil Member (35*f*).

The magnetic body layer (35*c*) on or in the conical spiral-coil member (35*f*) attaches to the composite magnetic body (35*a*) of the base plates (35*b*), so that when the conical spiral-coil member (35*f*) compresses into a plate formation, as the bristles (35*d*) gather together they are accommodated into the ferrule (31).

At this time, the composite magnetic body (35*a*) has its magnetic sections arranged radially and in alternately opposing polarity. The magnetic body layer (35*c*) on or in the spiral-coil member (35*f*) is arranged in magnetic sections at correspondingly equivalent intervals. The magnetic body layer (35*c*) on or in the spiral coil member (35*f*) attaches to the magnetic sections of the composite magnetic body (35*a*) on the base plate (35*b*), the conical spiral-coil member (35*f*) compresses into a plate formation, and as the bristles (35*d*) gather together they arc accommodated into the ferrule (31). When the magnetic body layer (35*c*) on or in the conical spiral-coil member (35*f*) corresponds with the opposite polarity magnetic sections of the composite magnetic body (35*a*) by means of the pivotal movement of the base plate (35*b*), they repel each other in opposite directions, and the conical spiral-coil member (35*f*) expands into a conical shape by repulsion force, providing for the bristles (35*d*) to be exposed outside of the ferrule (31). Or, alternatively, as a preferable arrangement, but not limited thereto, characterized by a brush head portion (30) where the spiral cable (35*c*) can be installed as an additional item inside the conical spiral-coil member (35*f*).

Here, the base plates (35*b*) are provided with a composite magnetic body, or alternatively, may be provided with a composite magnetic body coupled to the lower surface of the base plates (35*b*). Instead of the magnetic body layer (35*c*) inside one surface the spiral-coil member (35*f*), magnetic-particle clusters (36*c*') may be formed there.

Figure 17:
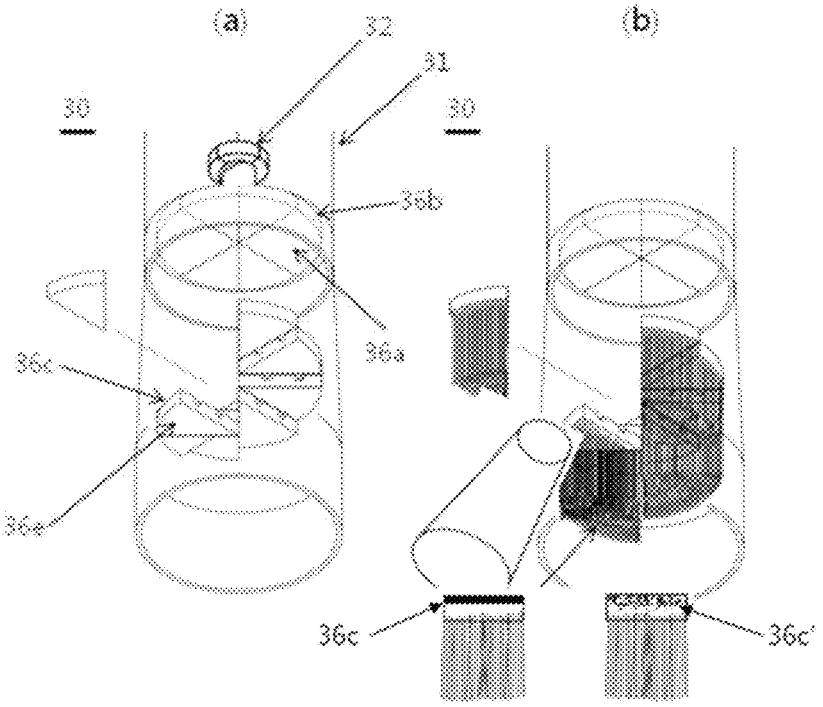

In FIG. 17, the brush head portion (30) has a multi-connector (32) formed inside one end of its ferrule (31) that is installed onto the end of the handle (10). On another surface is arranged radially, base plates (36*b*) comprising a composite magnetic body (36*a*) and to attach to the composite magnetic body (35*a*), a magnetic body layer (35*c*) is deposited on or in a surface. On the other surface, bristles are installed forming sector plates (36*e*).

Figure 18:
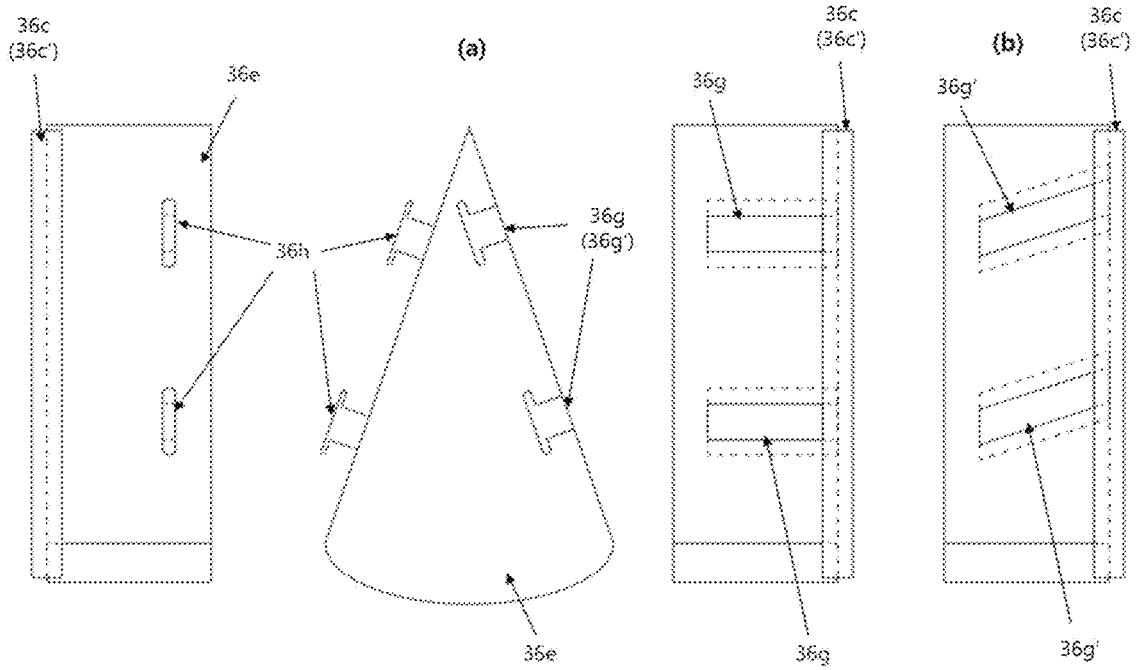

At this time, as shown in FIG. 18(*a*), the sector plate (36*e*) may be provided in plurality and arranged in a circle shape. On each plurality of sector plates (36*e*) is provided with a slot (36*e*) on one edge, and the other edge is provided with a protrusion (36*h*) corresponding in shape to the slot (36*g*), so the protrusion (36*h*) of a sector plate (36*e*) joins with the slot (36*g*) of another sector plate (36*e*), providing for coupling of sector plates (36*e*) to slide on each other.

Here, according to another embodiment of the present invention, preferably as shown in FIG. 18(*b*), instead of the slot (36*g*), it may be provided with a slot (36*g*') formed to be inclined at a certain angle. This enables sector plates (36*e*) to reduce in surface area and gather towards the middle of ferrule (31) as they descend inside the ferrule (31) without touching the inner surface of the ferrule (31), due to the sloping angle of the slots (36*g*') in the sector plates (36*e*). This easily gathers each sector plate (36*e*) in the middle of the ferrule.

Figure 19:
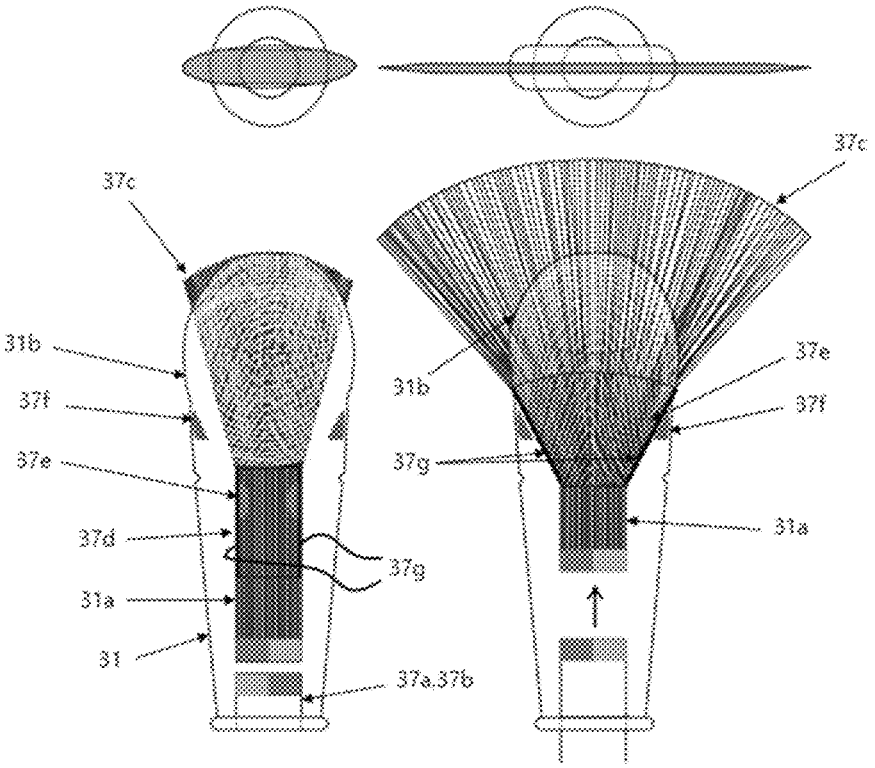

In FIG. 19, the brush head portion (30) which is installed onto the end of the handle (10), and a ferrule (31) which provides for: A linear guide hole (31*a*) on the end and a sector-shaped guide hole (31*b*) which encompasses the guide hole (31*a*); A push piece (37*b*) which forms a multi-connector (32) inside one end of the ferrule (31); An elastic member (37*d*) installed on one end of the linear guide hole (31*a*), and while being able to extend into a fan shape, has bristles (37*c*) installed on it; moving magnetic bodies (37*c*) formed on the circumference of the elastic member (37*d*); fixed magnets (37*f*) formed on the sector-shaped guide hole (31*b*) of the ferrule (31).

Thus, when the push piece (37*b*) is transferred to the outer periphery surface of the ferrule (31) and the elastic member (37*d*) enters the cavity of the sector-shaped guide hole (31*b*), while the moving magnetic bodies (37*f*) attach to the fixed magnetic bodies (37*f*), the elastic member (37*d*) expands and provides for the bristles (37*c*) to expand into a fan shape.

Here, according to the present invention, preferably, the clastic member (37*d*) is comprised of a flexible tube shape and provides for expanding the bristles (37*c*) into a fan shape.

Figure 20:
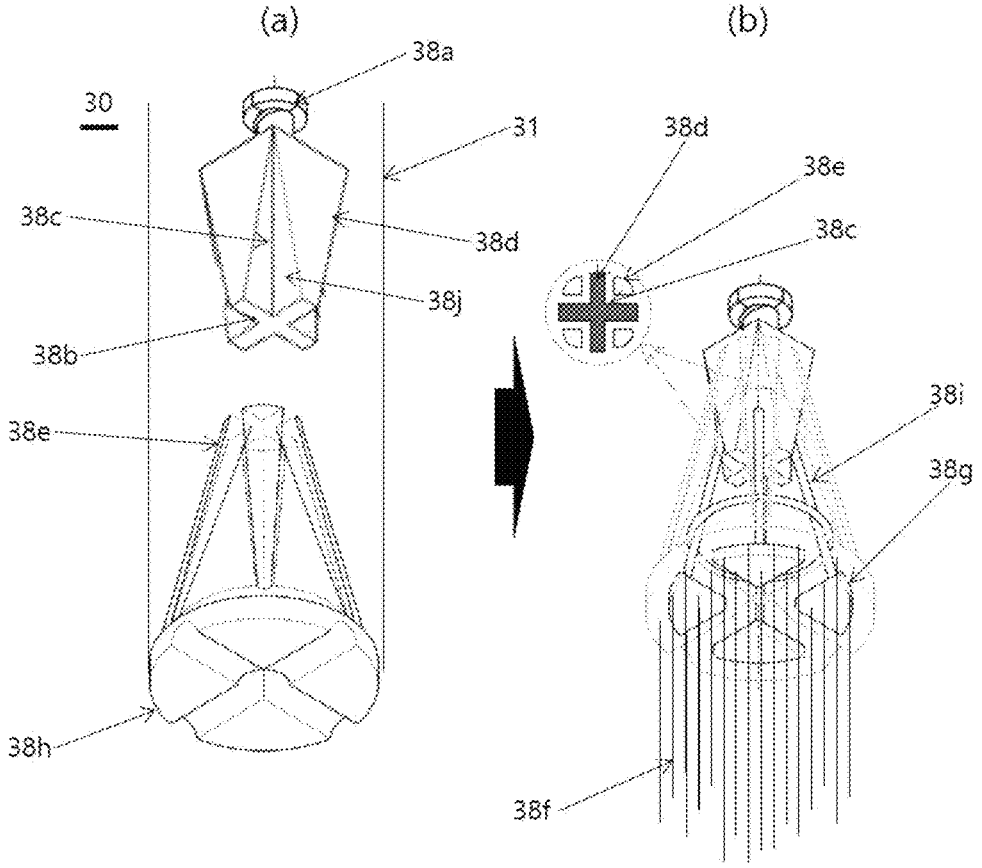

According to an embodiment of the present invention, as shown in FIG. 20, the brush head portion (30) which has a multi-connector (32) formed inside one end of its ferrule (31) that is installed onto the end of the handle (10). On the other end is provided a fixed magnetic body (38*b*), on in the surfaces of which are provided magnetic-particle clusters (36'); A push piece (38*d*) with incline rails (38*c*) arranged radially with spaces between them narrowing toward a fixed magnetic body (38*b*) installed at the outer periphery; a plurality of guide rails (38*e*) which expand out by means of sloping movement while the push piece (38*d*) approaches the incline rails (38*c*) the guide bars (38*e*) mount on the end; a surface is formed with bristles (38*f*); tilting plates (38*h*) are formed to cause moving magnetic bodies (38*g*) to attach to the fixed magnetic bodies (38*b*).

Here, according to another embodiment of the present invention, unlike one embodiment including the bar-shaped metal supports (38*i*), a magnetic surface (38*j*) may be formed in the surface of the guide rails (38*c*). It may be manufactured using a choice of either the bar-shaped metal supports (38*i*) or a magnetic surface (38*j*) may be formed in the surface of the guide rails (38*c*).

Thus, with the protruding movement of the push piece (38*d*), the guide bars (38*e*) move in a sloping angle while approaching the guide rails (38*c*). Due to the magnetic surface formed on the guide rails (38*c*), the guide bars (38*e*) push out the incline rails (38*c*) without contacting with them. The gap with the push piece (38*d*) is increased. Due to the attractive force between the fixed magnetic body (38*h*) and the moving magnetic body (38*g*), the tilting plate (38*h*) attaches to the push piece (38*d*). Due to the expansion movement of the push piece (38*d*), the tilting plates (38*h*) is bent and its diameter is reduced. As the bristles (38*f*) are gathered, they are accommodated inside the ferrule (31).

Figure 21:
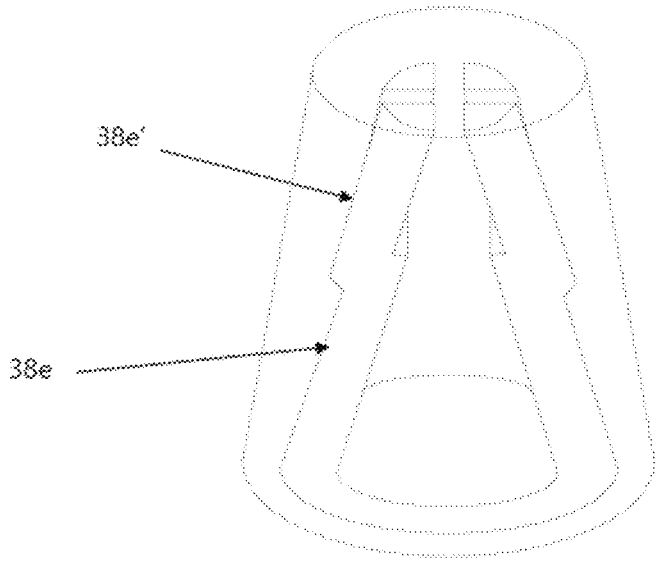

And as shown in FIG. 21, the guide bars (38*e*) are comprised of multiple-inclined rails (38*e'*) having mutually-different angles of incline at the ends, to increase the mutual expansion interval according to the distance of sloping movement by incline rails (38*c*); Leverage is increased by the above multiple-inclined rails (38*c'*) to widen the expansion gap of the push piece (38*d*) even in a narrow cavity inside a ferrule (31), which further curves the tilting plate (38*h*), making it easier for the bristles (38*f*) the gather together.

Figure 22:
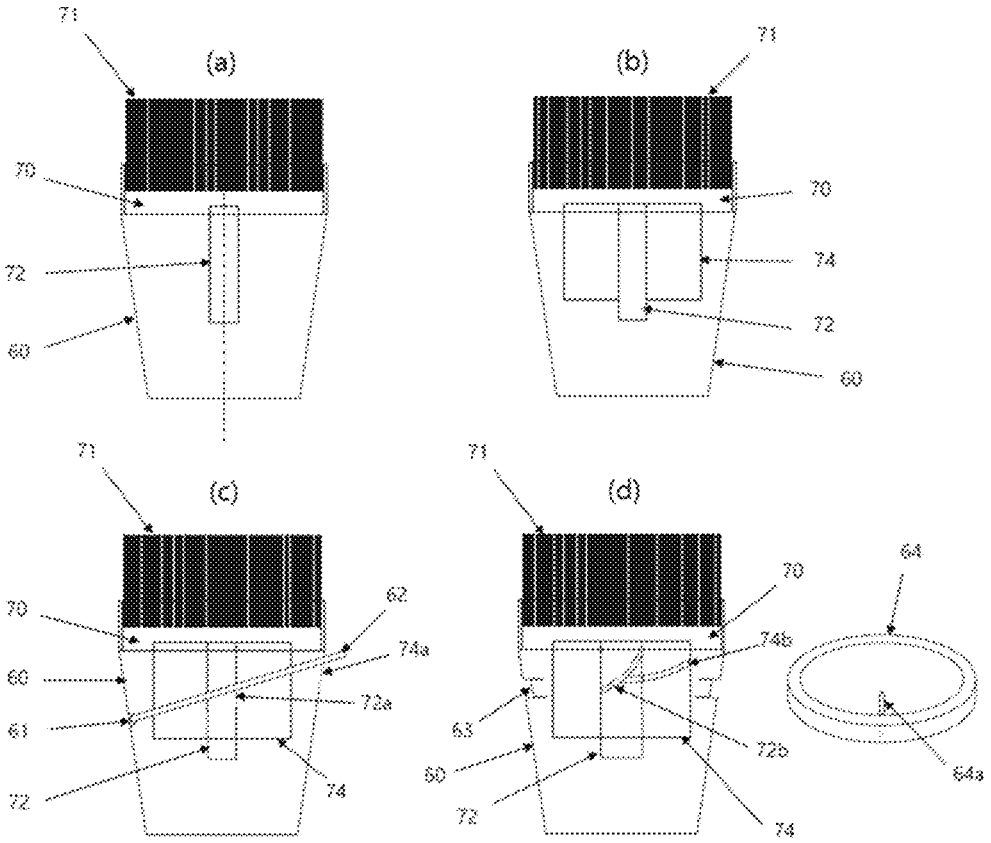
FIG. 22 to FIG. 23 are configuration diagrams showing the internal structure of a variety of ferrules of the modular brush according to embodiments of the present invention.

According to another embodiment of the present invention, as shown in FIG. 22(*a*), a ferrule (60) arranged at the end of a handle (10), a bristle-attaching portion (70), which is partially accommodated in the ferrule (60) and has bristles (71) on one side and any one of shaft (72) downwardly extending on central lower surface of the bristle-attaching portion (70) or a plurality of bars (73) attaching to lower surface of the bristle attaching portion (70), wherein the shaft (72) or the bars (73) arc drawn downwardly of the ferrule (60) so that the bristle-attaching portion (70) can flex in a curved manner with respect to its center and the bristle-attaching portion (70) can be accommodated in the ferrule (60) with diameter of the bristle-attaching portion (70) reduced.

Here, as shown in FIG. 22(*b*), the bristle-attaching portion (70) can flex in a curved manner with respect to its center portion and the bristle-attaching portion (70) can encase the shaft (72) outside the shaft (72) to further reduce diameter of the bristle-attaching portion (70), wherein tube (74) having larger diameter than that of the shaft (72).

In addition, as shown in FIG. 22(*c*), one end of the tube (74) is fixed to a lever fixing portion (61) arranged in inner wall of the ferrule (60), wherein a lever (62) is inserted into guide hole (72*a*) (74*a*) formed in the shaft (72) and the tube (74) and configured to penetrate guide hole (60*a*) formed in the ferrule (60) so that the lever (62) can move downward along the guide hole (60*a*) of the ferrule (60) and position of the shaft (72) is temporarily maintained wherein the bar (73) and tube (74) primarily moves downward and the lever (62) pushes the shaft (72) with reduced diameter of the bristle-attaching portion (70) so that the bristle-attaching portion (70) is inserted into inner wall of the ferrule (60) without contact.

And, as shown in FIG. 22(*d*), a track (63) having groove shape configured along perimeter of the ferrule (60), an adjuster-ring (64) provided with pin (64*a*), which is configured to protrude inwardly wherein the pin (64*a*) is configured to insert into curved guide holes (72*b*) (74*b*) arranged on outer surface of the shaft (72) and tube (74) and the adjuster-ring (64) is adjusted with the pin (64*a*) inserted into the guide holes (72*b*) (74*b*) so that velocity of downward movement of the shaft (72) and tube (74) is respectively adjusted according to curved shape of the guide holes (72*b*) (74*b*), wherein the bristle-attaching portion (70) is inserted into the ferrule (60) with reduce diameter.

Figure 23:
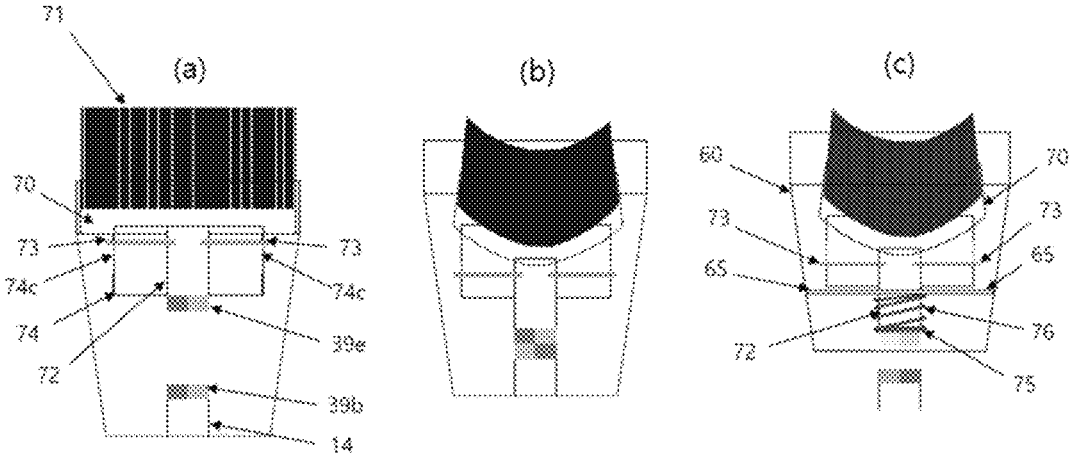

According to another embodiment of the present invention, as shown in FIG. 23(*c*), a shaft (72) provided with a plurality of bars (73), which are configured to extend outwardly of the shaft (72), wherein the tube (74) provided with guide hole (74*c*), into which the bar (73) penetrates, so that the shaft (72) can upwardly or downwardly slide with constant distance, wherein the bristle-attaching portion (70) is inserted into the ferrule (60) with retraction according to adjustment of polarity of moving magnetic bodies (39*c*) configured on one side of the shaft (72) and fixed magnetic bodies (39*b*) provided on coupling (14) of the handle (10).

In addition, as shown in FIG. 23(*c*), a spring (76) arranged between distance plate (65) provided at the center of the ferrule (60) and a stopper (75) configured by outwardly protruding end of the shaft (72) wherein the bristle-attaching portion (70) is connected with the coupling (14) with retraction so that the bristle attaching portion (70) can be inserted into the ferrule (60) with retraction due to the spring (76). Thus, according to embodiments of the present invention, selecting one of the above implementation examples is preferable, however, not to limit the scope of the invention. Some configurations may be modified and applied according to the initial design.

As described above, the modular brush according to the present invention the structure is improved so that brush heads of various grades stored inside the handle compartment, are exposed outwardly from the compartment in connection with the cover opening operation, enabling anyone to easily interchange the brush heads. A brush head stored inside the handle compartment is removed and easily attached to the end of the handle by a multi-connector and the coupling on the handle. Especially, through simple operation, the bristles retract into and are protected inside of the brush head, which has the effect of reducing its volume when unused and protect the stored bristles from damage.

On the other hand, the description of the technology disclosed herein is only an embodiment for structural or functional description, so the scope of the rights of the disclosed technology should not be construed as being limited by the embodiments described in the body of this specification.

That is, the embodiment is capable of various adaptions and may have a variety of forms, so the scope of the rights of the disclosed technology should be understood to include equalities that can realize the technical history. In addition, the purpose or effect presented in the disclosed technology does not mean that the particular embodiment should include all of it or include only such effects, so the scope of the rights of the disclosed technology should not be understood to be limited thereto.

In addition, the meaning of the terms described in the present invention will be understood as follows: Terms such as "first" and "second" are intended to distinguish one component from another, and the scope of rights should not be limited by these terms. For example, the first component may be named as a second component, and similarly the second component may be named as a first component.

Further, when it is stated that a component is "connected" to another component, it may be directly connected to the other component, but it should be understood that another component may exist in between these. On the other hand, it should be understood that a component does exists. While other expressions describing the relationship between the components, i.e., 'between-' and 'between-' or 'adjacent to-' and "directly adjacent to-" etc. should be interpreted similarly.

Any singular expression should be understood to include an expression of plurality, unless a different meaning is clear from the context. The term "includes" or "has" is intended to specify the presence of a set of features, numbers, steps, actions, components, parts or a combination thereof, and one or more other features or numbers, steps, actions, components, parts or a combination thereof should be understood as not precluding the presence or additional possibility.

Although the present invention as described above, has been described by limited embodiments and drawings, the present invention is not limited to the above embodiments or drawings. It is possible to modify and amend these mentions to a variety of other mentions by a person with ordinary knowledge in the fields to which the present invention belongs. Therefore, the concepts of the present invention should be ascertained only by the scope of the patent Claims described hereunder, and each of its equal or equivalent variants will be said to belong to the category of the idea of the present invention.

What is claimed is:

1. Modular brush, comprising a handle (10), in which a compartment (12) is formed, the handle being provided with coupling (14) at its end; comprising any one of a cover (20) being configured to open and close the compartment (12) when linearly moved in a longitudinal direction of the handle (10); or a cover tube (20*a*) having either a polygonal or cylindrical section to encase the handle (10); or C-shaped cover (20*b*) having shape corresponding to shape of the compartment (12); comprising a brush head portion (30), wherein a plurality of the brush head portions are accommodated in the compartment (12), and wherein the brush head portion is provided with multi-connector (32) configured to connect and lock the coupling (14) of the handle (10) so that any one of the brush head portions can be selectively drawn out and connected with the coupling (14); comprising a mounting portion (40) being arranged on a plurality of positions in the compartment (12) so that the mounting portion (40) can rotate about a pivotal axis (42) or pivotal protrusion (42*a*) and being provided with a mounting protrusion (44) so that the mounting protrusion (44) is connected with the multi-connector (32) of the brush head portion (30); and comprising a lifting portion (50) configured to make the brush head portion (30) protrude outside the compartment (12) by way of pivotal movement of the mounting portion (40) at an angle of inclination in connection with opening of the cover (20).

2. Modular brush according to claim 1, characterized in that the coupling (14) and the multi-connector (32) are attached to each other by way of magnetic body or connected with each other in a fitting manner by users wherein the coupling (14) and the multi-connector (32) are respectively configured to have a fitting groove and fitting hole.

3. Modular brush according to claim 1, characterized in that the lifting portion (50) comprises pinion gear (45) or wheel (45*a*) concentrically arranged on pivotal axis (42) or pivotal protrusion (42*a*) and rack gear (25) or gear teeth (25*a*) arranged on the cover (20), which can mesh with the pinion gear (45) or wheel (45*a*), that the rack gear (25) or gear teeth (25*a*) can be arranged at the end of the cover (20) so that the pinion gear (45) meshes with and makes pivotal movement with the rack gear (25) or the wheel (45*a*) meshes with and makes pivotal movement with the gear teeth (25*a*) when the end of the cover (20) moves adjacent to the mounting portion (40) and the cover (20) is opened, and that the brush head portion (30) makes pivotal movement at an angle of inclination by way of pivotal movement of the mounting portion (40), thus protrudes outside, or worm gear rotates by way of one of a third gear, wheel, gear teeth, grip or pulley belt, which is arranged on the cover (20) and the brush head portion (30) makes pivotal movement at an angle of inclination thus protrudes outside.

4. Modular brush according to claim 1, characterized in that the brush head portion (30) comprises a ferrule (31) arranged at the end of the handle (10), a separating plate (33*b*), which is arranged in the ferrule (31) and provided with a female thread (33*a*), a push piece (33*f*) provided with male screw (33*d*), which makes screw joint with the female thread (33*a*), wherein the push piece is provided with a multi-connector (32) at one end and moving magnetic body (33*e*) at the other end, and a tilting plate (33*i*) arranged in the ferrule (31) wherein the tilting plate (33*i*) is provided with fixed magnetic bodies (33*g*) on one side and bristles (33*h*) on the other side, that the moving magnetic body (33*e*) is arranged on a plurality of positions with respect to the fixed magnetic bodies (33*g*) wherein its surface forms inclined surface or horizontal surface when it corresponds with the fixed magnetic bodies (33*g*) wherein the tilting plate (33*i*) is accommodated into the ferrule (31) with its diameter reduced and in bent state when the moving magnetic body (33*e*) moves in among the fixed magnetic bodies (33*g*) by way of screw movement of the push piece (33*f*) and the inclined surface or horizontal surface of the fixed magnetic bodies (33*g*) attaches to the moving magnetic body (33*e*), or that the brush head portion (30) comprises a ferrule (31) arranged at the end of the handle (10), a separating plate (33*b*), which is arranged in the ferrule (31) and provided with a female thread (33*a*), a push piece (34*f*) provided with male screw (33*d*) which makes screw connection with the female thread (33*a*), wherein the push piece is provided with a multi-connector (32) at one end and moving magnetic body (34*e*) at the other end, and a tilting plate (34*i*) arranged in the ferrule (31) wherein the tilting plate (34*i*) is provided with fixed magnetic bodies (34*g*) on one side and bristles (34*h*) on the other side, wherein the moving magnetic body (34*e*) moves with screw pitch and attaches to the fixed magnetic bodies (34*g*) by way of screw movement of the push piece (34*f*) wherein the bristles (34*h*), while being gathered together are accommodated into the ferrule (31) when the tilting plate (34*i*) is drawn by way of reverse screw pitch movement of the push piece (34*f*).

5. Modular brush according to claim 1, characterized in that the brush head portion (30) comprises a ferrule (31) arranged at the end of the handle (10), a base plate (35*b*) arranged in the ferrule (31) and provided with a multi-connector (32) on one side and radially-arranged composite magnetic bodies (35*a*) on the other side, and a spiral coil member (35*f*) having conical shape, into which a spiral cable (35*e*) is built, wherein the spiral coil member (35*f*) is provided with magnetic-body layers (35*c*), which is configured to attach to the composite magnetic bodies (35*a*) on one side, and with bristles (35*d*) on the other side, that the bristles (35*d*), while gathering together are accommodated into the ferrule (31) when the magnetic-body layer (35*c*) of the spiral coil member (35*f*) attaches to composite magnetic bodies (35*a*) of the base plate (35*b*) and is compressed in a plate shape, that magnetic sections and opposite magnetic sections of the composite magnetic bodies (35*a*) arc alternately arranged in a radial manner wherein the magnetic-body layers (35*c*) of the spiral coil member (35*f*) corresponds to the magnetic sections and are arranged at equidistant intervals, wherein the bristles (35*d*), while gathered together arc accommodated into the ferrule (31) when the magnetic-body layers (35*c*) of the spiral coil member (35*f*) attach to the magnetic sections of the composite magnetic bodies (35*a*) of the base plate (35*b*) and are compressed in a plate shape, wherein the magnetic-body layers (35*c*) of the spiral coil member (35*f*) corresponds to the opposite magnetic sections of the composite magnetic bodies (35*a*) by way of pivotal movement of the base plate (35*b*) so that repellent force makes the spiral coil member (35*f*) expand in a conical manner and makes the bristles (35*d*) protrude outside, or that the spiral cable (35*e*) is further configured in the spiral coil member (35*f*) so that the spiral coil member (35*f*) can be provided with elastic force.

6. Modular brush according to claim 1, characterized in that the brush head portion (30) comprises a ferrule (31) arranged at the end of the handle (10), a base plate (36*b*) arranged in the ferrule (31) and provided with a multi-connector (32) on one side and radially-arranged composite magnetic bodies (36*a*) on the other side, and a sector-shaped plates (36*e*) arranged in a radial manner to attach to the composite magnetic bodies (36*a*) and configured to have magnetic-body layer (36*c*) or form magnetic-particle cluster (36*c*') on one side and bristles (36*d*) on the other side, wherein the sector-shaped plates (36*e*) is provided with any one of slots (36*g*') tilted at an angle on one side so that slots (36*g*) or the sector-shaped plates (36*e*) come together and protrusions (36*h*) having shape corresponding to shape of the slots (36*g*) wherein protrusions (36*h*) of the sector-shaped plates (36*e*) are connected with slots (36*g*) of the sector-shaped plates (36*e*) so that the plurality of the sector-shaped plates (36*e*) can be connected with each other to extend and slide.

7. Modular brush according to claim 1, characterized in that the brush head portion (30) comprises a ferrule (31) arranged on the handle (10) and having a linear guide hole (31*a*) at its end and a sector-shaped guide hole (31*b*) configured to encase the guide hole (31*a*), a push piece (37*b*) configured to have a multi-connector (37*a*) at the end of the ferrule (31), an elastic member (37*d*) arranged at the end of linear guide hole (31*a*) and extend in a sector-like manner and provided with bristles (37*c*), and moving magnetic bodies (37*e*) formed on perimeter of the elastic member (37*d*), and fixed magnetic bodies (37*f*) provided on a sector shape guide hole (31*b*) of the ferrule (31), wherein the push piece (37*b*) is transferred outwardly of the ferrule (31) and the elastic member (37*d*) approaches to section of the sector-shaped guide hole (31*b*) so that the moving magnetic bodies (37*c*) attach to the fixed magnetic bodies (37*f*) and the elastic member (37*d*) extends thus the bristles (37*c*) expand in a sector-like manner, wherein the elastic member (37*d*) is a flexible tube so that the bristles (37*c*) can extend in a sector like manner or guide stems (37*g*) are further provided on both sides of the elastic member (37*d*) so that the bristles (37*c*) can extend in a sector-like manner.

8. Modular brush according to claim 1, characterized in that the brush head portion (30) comprises a ferrule (31) arranged at the end of the handle a push piece (38*d*) arranged in the ferrule (31) and provided with a multi-connector (38*a*) on one side and a fixed magnetic bodies (38*b*) on the other side, wherein the push piece is provided with magnetic-particle cluster (36*c*') on its surface or inside and incline rails (38*c*) are radially arranged on their perimeter with their distance reduced toward the fixed magnetic bodies (38*b*), a plurality of guide rails (38*e*), which move in a proximity with the incline rails (38*c*) of the push piece (38*d*) and extend by way of tilting movement, or alternatively guide rails (38*e*), on which multiple-inclined rails (38*e*') having different angle of inclination on their ends so that extending distance thereof increases according to distance of tilting movement with respect to the incline rails (38*c*), a tilting plate (38*h*) arranged at the end of the guide rails (38*e*) and provided with bristles (38*f*) on one side and moving magnetic bodies (38*g*) configured to attach to fixed magnetic bodies (38*b*), bar-shaped metal support (38*i*) arranged in the guide rails (38*e*), and moving magnetic bodies (38*g*) connected with the bar-shaped metal support (38*i*) and radially arranged in the tilting plate (38*h*) or magnetic surface (38*j*) formed inside the incline rails (38*c*) without bar-shaped metal support (38*i*), wherein the guide rails (38*e*) conduct tilting movement by way of force of movement of protruding push piece (38*d*) so that the guide rails (38*e*) push the incline rails (38*c*) without contact, wherein the tilting plate (38*h*) attaches to the push piece (38*d*) by way of force of attachment of the fixed magnetic bodies (38*b*) and moving magnetic bodies (38*g*) with distance of push pieces (38*d*) increased, wherein the tilting plate (38*h*) flexes by way of extending movement of the push pieces (38*d*) so that the bristles (38*f*) can gather together with its diameter reduced and be accommodated in the ferrule (31).

9. A modular brush characterized by a first construction, a second construction, a third construction, or a fourth construction:

wherein the first construction comprises: a ferrule (60) arranged at the end of a handle (10), a bristle-attaching portion (70), which is partially accommodated in the ferrule (60) and has bristles (71) on one side and any one of: a shaft (72) downwardly extending on a central lower surface of the bristle-attaching portion (70) or a plurality of bars (73) attaching to a lower surface of the bristle-attaching portion (70), wherein the shaft (72) or the plurality of bars (73) arc drawn downwardly of the ferrule (60) so that the bristle-attaching portion (70) can flex in a curved manner with respect to a center portion of the bristle-attaching portion (70) and the bristle-attaching portion (70) can be accommodated in the ferrule (60) with a diameter of the bristle-attaching portion (70) reduced, wherein the bristle-attaching portion (70) can flex in a curved manner with respect to the center portion of the portion of the bristle-attaching portion (70) and the bristle-attaching portion (70) can encase the shaft (72) outside the shaft (72) to further reduce a diameter of the bristle-attaching portion (70), wherein a tube (74) having a larger diameter than that of the shaft (72) is further provided and an end of the tube is fixed to a lever fixing portion (61) arranged in an inner wall of the ferrule (60), wherein a lever (62) is inserted into a guide hole (72*a*) (74*a*) formed in the shaft (72) and the tube (74) and configured to penetrate a guide hole (60*a*) formed in the ferrule (60) so that the lever (62) can move downward along the guide hole (60*a*) of the ferrule (60) and a position of the shaft (72) is temporarily maintained wherein the bar (73) and the tube (74) primarily move downward and the lever (62) pushes the shaft (72) with a reduced diameter of the bristle-attaching portion (70) so that the bristle-attaching portion (70) is inserted into an inner wall of the ferrule (60) without contact;

wherein the second construction comprises: a track (63) having a groove shape configured along a perimeter of a ferrule (60), an adjuster-ring (64) provided with a pin (64*a*), which is configured to protrude inwardly wherein the pin (64*a*) is configured to insert into curved guide holes (72*b*) (74*b*) arranged on an outer surface of a shaft (72) and a tube (74) and the adjuster-ring (64) is adjusted with the pin (64*a*) inserted into the curved guide holes (72*b*) (74*b*) so that velocity of downward movement of the shaft (72) and the tube (74) is respectively adjusted according to a curved shape of the curved guide holes (72*b*) (74*b*), wherein a bristle-attaching portion (70) is inserted into the ferrule (60) with reduced diameter;

wherein the third construction comprises: a shaft (72) provided with a plurality of bars (73), which are configured to extend outwardly of the shaft (72), wherein a tube (74) provided with a guide hole (74*c*), into which the plurality of bars (73) penetrates, so that the shaft (72) can upwardly or downwardly slide with constant distance, wherein a bristle attaching portion (70) is inserted into a ferrule (60) with retraction according to adjustment of polarity of moving magnetic bodies (39*e*) configured on one side of the shaft (72) and fixed magnetic bodies (39*b*) provided on a coupling (14) of a handle (10); and wherein the fourth construction comprises: a spring (76) arranged between a distance plate (65) provided at a center of a ferrule (60) and a stopper (75) configured by an outwardly protruding end of a shaft (72) wherein a bristle attaching portion (70) is connected with a coupling (14) with retraction so that the bristle attaching portion (70) can be inserted into the ferrule (60) with retraction due to the spring (76).

* * * * *